US010233045B2

(12) United States Patent
Sato et al.

(10) Patent No.: US 10,233,045 B2
(45) Date of Patent: Mar. 19, 2019

(54) SHEET DELIVERY SYSTEM AND SHEET DELIVERY METHOD USING SAME

(71) Applicant: ZUIKO CORPORATION, Osaka (JP)

(72) Inventors: Hitoshi Sato, Osaka (JP); Yosuke Nishimura, Osaka (JP); Shinichiro Nagafuchi, Osaka (JP)

(73) Assignee: ZUIKO CORPORATION, Osaka (JP)

( * ) Notice: Subject to any disclaimer, the term of this patent is extended or adjusted under 35 U.S.C. 154(b) by 44 days.

(21) Appl. No.: 15/322,267

(22) PCT Filed: Jun. 18, 2015

(86) PCT No.: PCT/JP2015/067593
§ 371 (c)(1),
(2) Date: Dec. 27, 2016

(87) PCT Pub. No.: WO2016/002530
PCT Pub. Date: Jan. 7, 2016

(65) Prior Publication Data

US 2017/0137248 A1 May 18, 2017

(30) Foreign Application Priority Data

Jun. 30, 2014 (JP) ..... 2014-134733

(51) Int. Cl.
*B65H 19/18* (2006.01)
*B65H 19/10* (2006.01)
*B65H 19/20* (2006.01)

(52) U.S. Cl.
CPC ..... *B65H 19/18* (2013.01); *B65H 19/102* (2013.01); *B65H 19/105* (2013.01);
(Continued)

(58) Field of Classification Search
CPC ..... B65H 19/18; B65H 19/20; B65H 19/102; B65H 2406/33; B65H 2301/46172; B65H 2301/4607
See application file for complete search history.

(56) References Cited

U.S. PATENT DOCUMENTS 3,780,960 A * 12/1973 Tokuno ..... B65H 19/1836 226/95
4,984,750 A * 1/1991 Shigeta ..... B65H 18/28 156/504
(Continued)

FOREIGN PATENT DOCUMENTS

EP 0 539 983 5/1993
JP 58-144039 8/1983
(Continued)

OTHER PUBLICATIONS

Extended European Search Report dated Jun. 7, 2017 in European Application No. 15814852.8.
(Continued)

*Primary Examiner* — Sang K Kim
(74) *Attorney, Agent, or Firm* — Wenderoth, Lind & Ponack, L.L.P.

(57) ABSTRACT

A sheet delivery system includes: a joining unit configured to join, to an intermediate section of a sheet being delivered from a delivery-side original material roll, an end section of a sheet of a standby-side original material roll; and an operation robot configured to retrieve the end section of the sheet from the standby-side original material roll and convey the end section of the sheet to the joining unit. The sheet delivery system is configured to set, in advance, a sheet retrieval position at which the sheet is retrieved from each of the original material rolls, for each of the original material rolls. The operation robot is configured to convey the end
(Continued)

section of the sheet from each of the sheet retrieval positions to the joining unit.

4 Claims, 32 Drawing Sheets

(52) U.S. Cl.
CPC ..... *B65H 19/1852* (2013.01); *B65H 19/1873* (2013.01); *B65H 19/20* (2013.01); *B65H 2301/41398* (2013.01); *B65H 2301/4604* (2013.01); *B65H 2301/4607* (2013.01); *B65H 2301/46115* (2013.01); *B65H 2301/46172* (2013.01); *B65H 2406/33* (2013.01); *B65H 2406/331* (2013.01); *B65H 2406/334* (2013.01); *B65H 2555/31* (2013.01)

(56) References Cited

U.S. PATENT DOCUMENTS

| | | | | |
|---|---|---|---|---|
| 5,285,978 | A | 2/1994 | Sakano et al. | |
| 5,730,389 | A * | 3/1998 | Biagiotti | B65H 19/1852 156/502 |
| 6,820,836 | B2 * | 11/2004 | Sato | B65H 19/1852 156/504 |
| 2014/0012420 | A1 | 1/2014 | Yasue et al. | |

FOREIGN PATENT DOCUMENTS

| | | |
|---|---|---|
| JP | 2-23139 | 1/1990 |
| JP | 2-75555 | 3/1990 |
| JP | 5-123152 | 5/1993 |
| JP | 7-101602 | 4/1995 |
| JP | 2005-231789 | 9/2005 |
| JP | 2009-018935 | 1/2009 |
| WO | 0056645 | 9/2000 |
| WO | 2013/027283 | 2/2013 |

OTHER PUBLICATIONS

International Search Report dated Sep. 8, 2015 in International (PCT) Application No. PCT/JP2015/067593.
Office Action dated Apr. 13, 2018 in Chinese Patent Application No. 201580034771.5 with English-language abstract.
Notification of Reasons for Refusal dated Apr. 3, 2018 in Japanese Application No. 2016-531262, with English translation.

* cited by examiner

SHEET DELIVERY SYSTEM AND SHEET DELIVERY METHOD USING SAME

TECHNICAL FIELD

The present invention relates to a system and a method for continuously delivering a sheet.

BACKGROUND ART

Conventionally, apparatuses are known for continuously delivering a sheet from an original material roll formed by winding the sheet.

When a remaining sheet amount of the original material roll becomes small in an apparatus of this type, for example, a joining operation of sheets such as that shown in FIG. 29 to FIG. 32 is performed.

Specifically, in order to perform the joining operation, as shown in FIG. 29, an original material roll (hereinafter, referred to as a standby-side original material roll) R2 which stands by for delivery of a sheet W is installed in advance adjacently to an original material roll (hereinafter, referred to as a delivery-side original material roll) R1 which delivers the sheet W.

As shown in FIG. 30, when a remaining amount of the sheet W of the delivery-side original material roll becomes small, an end section of the sheet W is retrieved from the standby-side original material roll R2 and an adhesive (for example, a tape T) is affixed to the end section of the sheet W.

Next, as shown in FIG. 31, using the tape T, the end section of the sheet W of the standby-side original material roll R2 is connected to an intermediate section of the sheet W of the delivery-side original material roll R1 and the sheet W of the delivery-side original material roll R1 is cut at an upstream position (a position denoted by a triangle in FIG. 31) relative to the tape T.

Accordingly, as shown in FIG. 32, tension applied to the sheet W on a downstream side of both original material rolls R1 and R2 is applied via the tape T to the sheet W of the standby-side original material roll R2, and the sheet W is delivered from the standby-side original material roll R2. In other words, the standby-side original material roll R2 performs a role of a next delivery-side original material roll R1.

As an apparatus for automatically performing the joining operation described above, for example, an apparatus described in Japanese Unexamined Patent Publication No. H7-101602 is known.

The apparatus described in Japanese Unexamined Patent Publication No. H7-101602 includes: a roll holding unit which holds a delivery-side original material roll and a standby-side original material roll; a joining unit which joins a sheet of the standby-side original material roll to a sheet of the delivery-side original material roll; and an XY mobile robot which retrieves an end section of the sheet of the standby-side original material roll and which guides the end section to the joining unit.

The XY mobile robot includes a head which is movable between a retrieval position of the sheet of the standby-side original material roll that is set in the roll holding unit and the joining unit.

The roll holding unit includes a mechanism which, after the sheet of the standby-side original material roll is joined to the sheet of the delivery-side original material roll, moves the standby-side original material roll to a sheet delivery position set in advance and, at the same time, moves the delivery-side original material roll to the retrieval position. Subsequently, the delivery-side original material roll having been moved to the retrieval position is detached and a new standby-side original material roll is attached to the roll holding unit.

However, the apparatus described in Japanese Unexamined Patent Publication No. H7-101602 requires a mechanism for interchanging positions of the standby-side original material roll and the delivery-side original material roll, and the mechanism is large in accordance with a diameter of an unused original material roll.

Therefore, a structure of the roll holding unit becomes complex and a size of the roll holding unit increases.

SUMMARY OF INVENTION

An object of the present invention is to provide a sheet delivery system capable of simplifying a structure of a roll holding unit and downsizing the roll holding unit, and a sheet delivery method using the sheet delivery system.

In order to solve the problem described above, the present invention provides a sheet delivery system for continuously delivering a sheet, the sheet delivery system including: a roll holding unit which holds a plurality of original material rolls each formed by winding a sheet, in a state where delivery of the sheet is allowed; a joining unit which joins, to an intermediate section of a sheet being delivered from a delivery-side original material roll among the plurality of original material rolls held by the roll holding unit, an end section of a sheet of a standby-side original material roll that is a roll other than the delivery-side original material roll among the plurality of original material rolls held by the roll holding unit; and an end section conveying apparatus which retrieves the end section of the sheet from the standby-side original material roll and which conveys the end section of the sheet to the joining unit, wherein the sheet delivery system sets, in advance, a sheet retrieval position for retrieving a sheet from each of the plurality of original material rolls, for each of the plurality of original material rolls held by the roll holding unit, and the end section conveying apparatus is configured to convey the end section of the sheet from each of the sheet retrieval positions to the joining unit.

In addition, the present invention provides a sheet delivery method using the sheet delivery system described above, the sheet delivery method including: a delivery step of delivering a sheet from the delivery-side original material roll; a conveying step of retrieving an end section of a sheet from the sheet retrieval position for the standby-side original material roll and conveying the end section of the sheet to the joining unit using the end section conveying apparatus when a remaining sheet amount of the delivery-side original material roll falls below a remaining amount set in advance by the delivery step; and a joining step of joining the end section of the sheet of the standby-side original material roll to an intermediate section of the sheet of the delivery-side original material roll using the joining unit.

According to the present invention, a structure of a roll holding unit can be simplified and the roll holding unit can be downsized.

DESCRIPTION OF EMBODIMENTS

Hereinafter, embodiments of the present invention will be described with reference to the accompanying drawings. It is to be understood that the following embodiments are merely examples embodying the present invention and are not intended to limit the technical scope of the present invention.

First Embodiment

Figure 1:
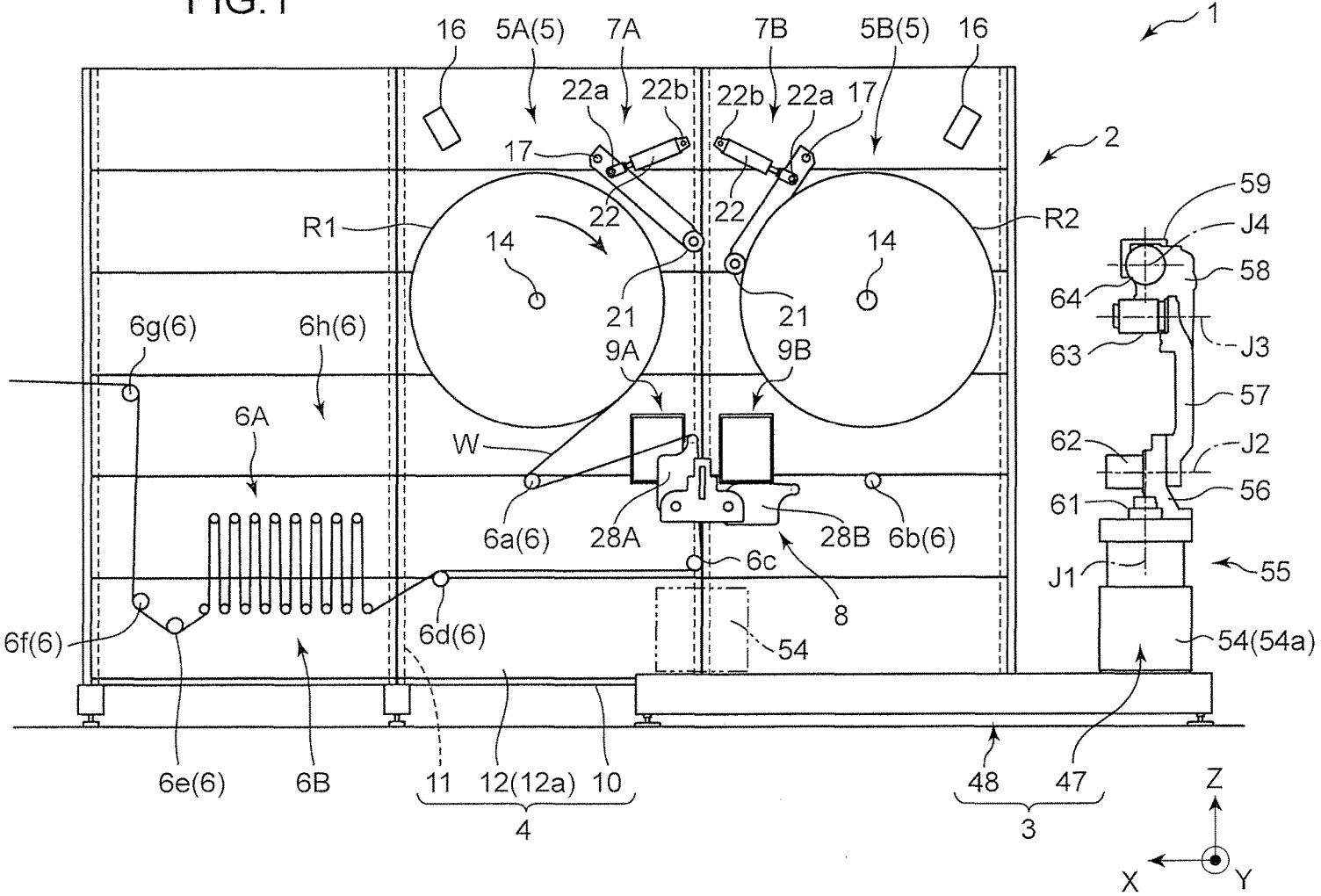
FIG. 1 is a front view showing an overall configuration of a sheet delivery system according to a first embodiment of the present invention.
Figure 2:
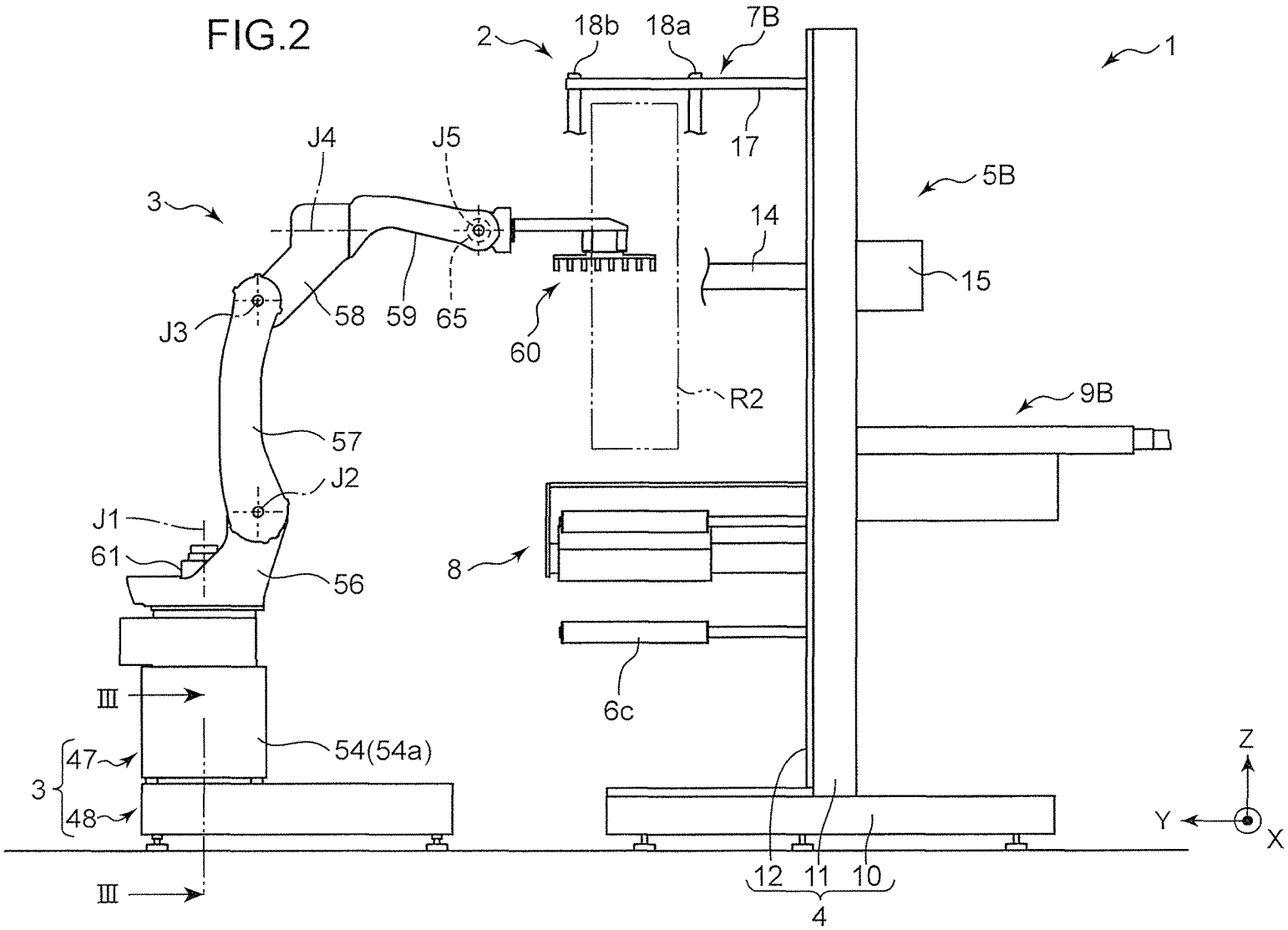
FIG. 2 is a side view of the sheet delivery system shown in FIG. 1.

Referring to FIG. 1 and FIG. 2, a sheet delivery system 1 is configured to continuously deliver a sheet W.

Specifically, the sheet delivery system 1 includes: a sheet delivery apparatus 2 which holds original material rolls R1 and R2, each formed by winding the sheet W and which continuously delivers the sheet W of the original material rolls R1 and R2; an operation robot (an end section conveying apparatus) 3 which, when a remaining amount of the sheet W of one original material roll (for example, the original material roll R1) becomes small in the sheet delivery apparatus 2, retrieves the sheet W of the other original material roll (for example, the original material roll R2) and conveys the sheet W to a joining unit 8 of the sheet delivery apparatus 2; and a controller 70 (refer to FIG. 14) which controls operations of the sheet delivery apparatus 2 and the operation robot 3.

The sheet delivery apparatus 2 includes: a roll holding unit 5 which holds the original material rolls R1 and R2 in a state where delivery of the sheet W is allowed; a guiding unit 6 which guides the sheets of the original material rolls R1 and R2 held by the roll holding unit 5 along a path set in advance; end section retrieving units 7A and 7B which respectively retrieves the sheets of the original material rolls R1 and R2 held by the roll holding unit 5; a joining unit 8 which joins the sheet of the original material roll R1 and the sheet of the original material roll R2 to each other; tape affixing units 9A and 9B which respectively affix a tape T (refer to FIG. 23) to the sheets of the original material rolls R1 and R2; and a supporting member 4 which supports these units.

The supporting member 4 includes: a bottom plate 10 arranged parallel to an installation surface; four supporting columns 11 erected on the bottom plate 10; and a supporting plate 12 fixed to a side surface of the supporting columns 11.

The four supporting columns 11 are arranged in a single row.

The supporting plate 12 includes 18 supporting plate pieces 12*a*, and an attachment surface for attaching the configuration described above is formed by main surfaces of the supporting plate pieces 12*a*. Specifically, the 18 supporting plate pieces 12*a* are detachably attached to two supporting columns 11 adjacent to each other so as to span the two supporting columns 11. In addition, six supporting plate pieces 12*a* aligned in a height direction of the supporting columns 11 are attached to two supporting columns 11 adjacent to each other. Furthermore, the 18 supporting plate pieces 12*a* are fixed to the supporting columns 11 so that main surfaces of the 18 supporting plate pieces 12*a* are arranged on a same plane.

In the following description, a direction in which the four supporting columns 11 are lined up is assumed to be an X direction, a direction perpendicular to the main surfaces of the supporting plate pieces 12*a* is assumed to be a Y direction, and the height direction of the supporting columns 11 is assumed to be a Z direction.

Moreover, each of the supporting plate pieces 12*a* holds the components of the sheet delivery apparatus 2 so that a part of the components can be readily replaced.

For example, an uppermost supporting plate piece 12*a* provided in a rightmost column in FIG. 1 holds the second end section retrieving unit 7B to be described later. In addition, a third-from-top supporting plate piece 12*a* in the rightmost column holds the second roll holding unit 5B to be described later. Furthermore, a fourth-from-top supporting plate piece 12*a* in the rightmost column holds the tape affixing unit 9B to be described later. By detaching these supporting plate pieces 12*a* from the supporting column 11 and attaching supporting plate pieces 12*a* holding other components, components can be readily replaced.

The roll holding unit 5 includes: a first roll holding unit 5A which holds the original material roll R1; and a second roll holding unit 5B which holds the original material roll R2. Moreover, since both roll holding units 5A and 5B have configurations symmetrical in the X direction, only the second roll holding unit 5B will be described and a description of the first roll holding unit 5A will be omitted.

The second roll holding unit 5B includes: a holding shaft 14 which supports the original material roll R2 in a state where the holding shaft 14 penetrates a center of the original material roll R2; a roll driving motor 15 which rotationally drives the holding shaft 14; and a remaining sheet amount detector 16 configured to detect a remaining amount of the sheet W of the original material roll R2.

The holding shaft 14 penetrates the supporting plate 12 in the Y direction and is further fixed to the supporting plate 12 in a state where the holding shaft 14 is rotatable around an axis along the Y direction with respect to the supporting plate 12.

The roll driving motor 15 corresponds to an original material roll driving unit which rotationally drives the original material rolls R1 and R2 around central axes thereof. Specifically, the roll driving motor 15 is attached to an end section of the holding shaft 14 on an opposite side to an end section which supports the original material roll R2.

The remaining sheet amount detector 16 is attached to the supporting plate 12 at a position separated from the original material roll R2 that is supported by the holding shaft 14. In addition, the remaining sheet amount detector 16 includes a sensor configured to detect a distance from the remaining sheet amount detector 16 to an outer peripheral surface of the original material roll R2. The controller 70 to be described later calculates radius of the original material rolls R1 and R2 or, in other words, a remaining sheet amount based on a result of detection by the remaining sheet amount detector 16 and a position of the holding shaft 14.

The guiding unit 6 includes: a plurality of support rollers 6*a* to 6*g* which support the sheet W delivered from the original material rolls R1 and R2 along a prescribed path; and a sheet storage mechanism 6*h* configured to temporarily store a prescribed amount of the sheet W delivered from the original material rolls R1 and R2.

Among the support rollers 6*a* to 6*g*, the support rollers 6*c* to 6*g* are commonly used for the sheets W of both original material rolls R1 and R2. On the other hand, the support roller 6*a* is used to guide the sheet W of the first original material roll R1 to the joining unit 8 to be described later. In addition, the support roller 6*b* is used to guide the sheet W of the second original material roll R2 to the joining unit 8.

The sheet storage mechanism 6*h* includes: an upper roller group 6A constituted by a plurality of rollers; a lower roller group 6B constituted by a plurality of rollers; and a moving mechanism (not shown) configured to move the roller groups 6A and 6B so that the roller groups 6A and 6B relatively approach each other or separate from each other. By providing the sheet W between the upper roller group 6A and the lower roller group 6B in a state where the upper roller group 6A and the lower roller group 6B are separated from each other and bringing the upper roller group 6A and the lower roller group 6B close to each other in this state, the sheet W can be delivered to downstream sides of both roller groups 6A and 6B in a state where rotations of the original material rolls R1 and R2 are stopped. Due to the sheet storage mechanism 6*h*, a joining operation of the sheet W to be described later can be performed in a state where rotations of both original material rolls R1 and R2 are stopped.

The first and second end section retrieving units 7A and 7B are attached to the supporting plate 12 at a position which is above both holding shafts 14 of the roll holding unit 5 and which is between both holding shafts 14 in the X direction. Moreover, since the first and second end section retrieving units 7A and 7B have configurations symmetrical in the X direction, only the second end section retrieving unit 7B will be described and a description of the first end section retrieving unit 7A will be omitted.

Figure 5:
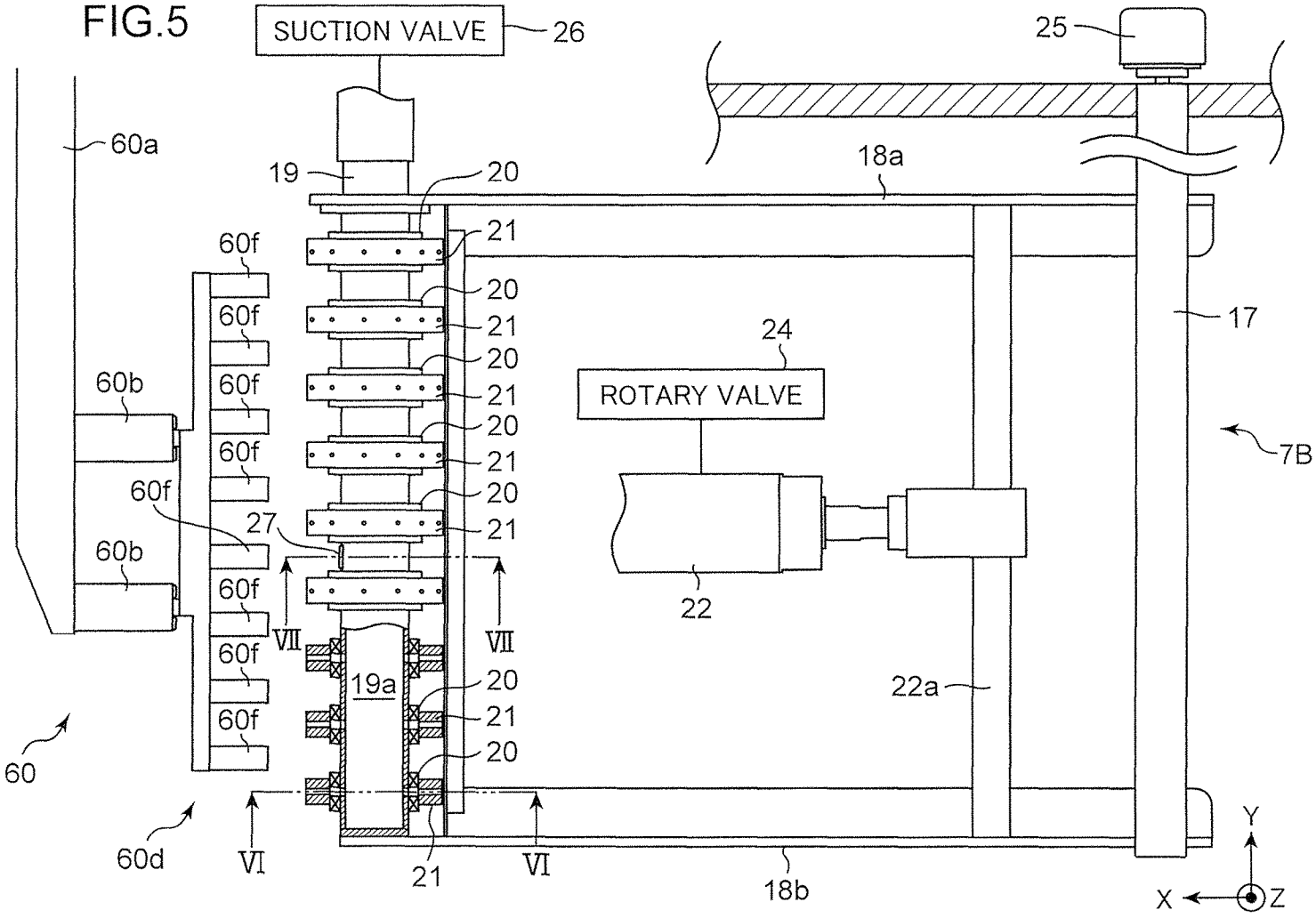
FIG. 5 is a partially sectional plan view showing an enlargement of an end section retrieving unit shown in FIG. 1.

Referring to FIG. 1, FIG. 2, and FIG. 5, the second end section retrieving unit 7B includes: a rotary shaft 17 extending in the Y direction from the supporting plate 12; a pair of arms 18*a* and 18*b* respectively having a base end section fixed to the rotary shaft 17; a supporting shaft 19 provided so as to span between respective tip sections of the arms 18*a* and 18*b*; a plurality of suction rollers 21 rotatably attached to an outer peripheral surface of the supporting shaft 19 via a plurality of bearings 20; a rotary cylinder 22 which rotationally drives both arms 18*a* and 18*b*; a rotary valve 24 which controls extension/contraction operations of the rotary cylinder 22; a rotational angle detector 25 which detects a rotational angle of the rotary shaft 17; a suction valve 26 connected to the supporting shaft 19; and an end section detector 27 attached to the supporting shaft 19.

The rotary shaft 17 penetrates the supporting plate 12 in the Y direction and is further fixed to the supporting plate 12 in a state where the rotary shaft 17 is rotatable around an axis along the Y direction with respect to the supporting plate 12. A rotational angle of the rotary shaft 17 is detected by the rotational angle detector 25 attached to a base end section of the rotary shaft 17.

The arms 18*a* and 18*b* correspond to rotary supporting members which are rotatable with respect to the roll holding unit 5 (the supporting plate 12) around the rotary shaft 17 being parallel to a central axis (the holding shaft 14) of the original material roll R2 so that a distance between the supporting shaft 19, to be described later, and the central axis of the original material roll R2 is adjustable.

Specifically, the arms 18*a* and 18*b* rotate around an axis of the rotary shaft 17 in accordance with extension/contraction operations of the rotary cylinder 22. A base end section (a head-side end section) of the rotary cylinder 22 is attached by a shaft 22*b* to the supporting plate 12 in a state where the base end section is rotatable with respect to the supporting plate 12 around an axis along the Y direction. On the other hand, a distal end section (a rod-side end section) of the rotary cylinder 22 is attached by a shaft 22*a* to intermediate sections of both arms 18*a* and 18*b* in a state where the distal end section is rotatable with respect to both arms 18*a* and 18*b* around an axis along the Y direction. The rotary valve 24 is configured to control supply of air to the rotary cylinder 22 and discharge of air from the rotary cylinder 22.

The supporting shaft 19 is a hollow shaft which internally includes a suction chamber 19*a*. A distal end section of the supporting shaft 19 includes a bottom wall for closing the suction chamber 19*a*. On the other hand, a base end section of the supporting shaft 19 is connected to a suction source (not shown) via the suction valve 26. Therefore, by opening the suction valve 26, air inside the suction chamber 19*a* is sucked out by the suction source.

Figure 6:
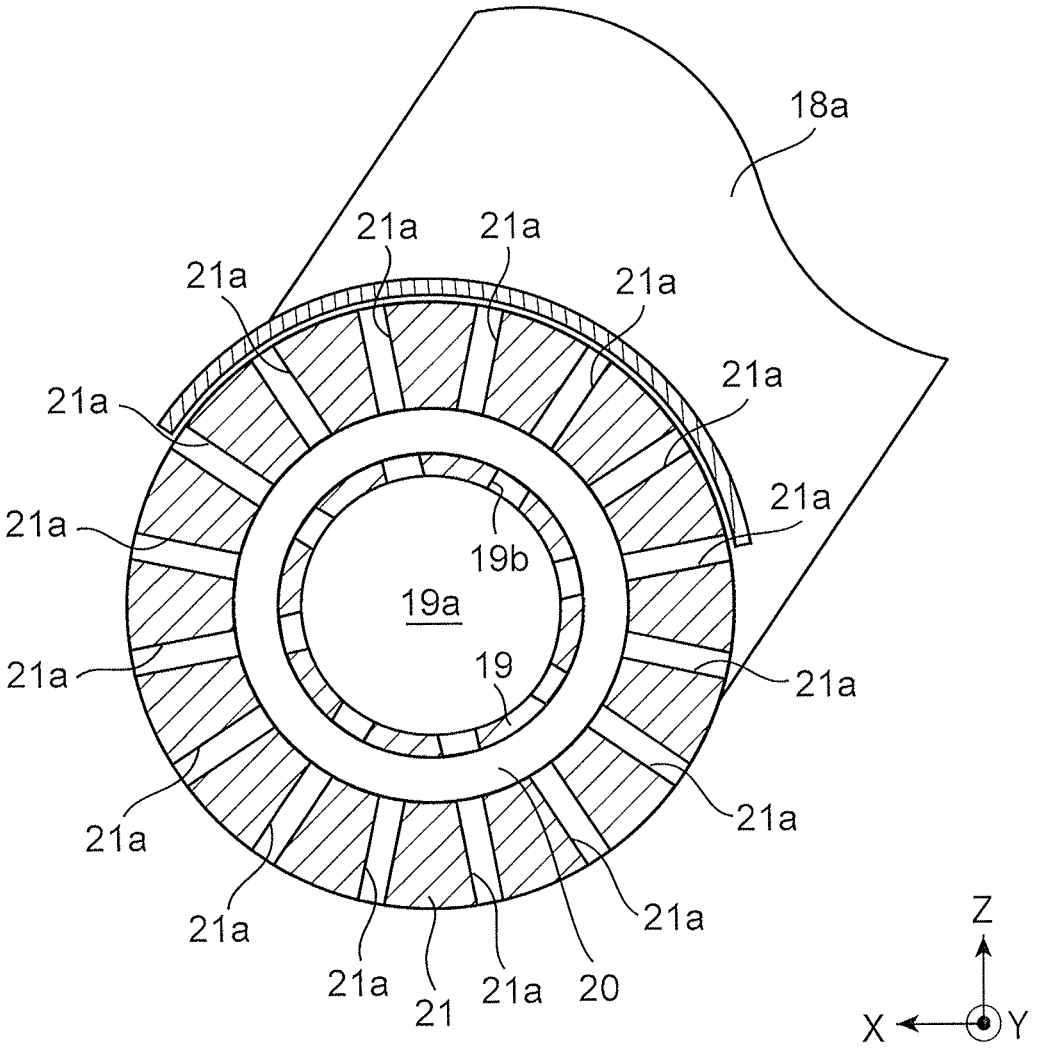
FIG. 6 is a sectional view taken along line VI-VI in FIG. 5.

In addition, as shown in FIG. 6, the supporting shaft 19 includes a through-hole 19*b* which penetrates an outer peripheral wall thereof. The plurality of bearings 20 are provided at positions separated from the through-hole 19*b* in an axial direction (Y direction) of the supporting shaft 19, and the suction rollers 21 are provided so as to span between adjacent bearings 20. A suction roller 21 includes a through-hole 21*a* which penetrates the suction roller 21 in a radial direction thereof. Accordingly, the suction chamber 19*a* is opened to the outside in the radial direction of the suction roller 21 through spaces between adjacent bearings 20 and the through-hole 21*a*. Therefore, by bringing the sheet W into contact with an outer peripheral surface of the suction roller 21 in a state where the suction valve 26 is opened, the sheet W is suctioned by the suction roller 21.

As described above, the plurality of suction rollers 21 are attached to the supporting shaft 19 in a state where the suction rollers 21 are rotatable around the axis of the supporting shaft 19 and are arranged separated from each other in a direction (Y direction) which is parallel to the axis. In addition, the suction rollers 21 are configured to come into rolling contact with the outer peripheral surface of the original material roll R2 in accordance with the original material roll R2 being rotationally driven, and include an outer peripheral surface configured to suction an end section of the sheet W in order to separate the end section of the sheet W from the original material roll R2.

Figure 7:
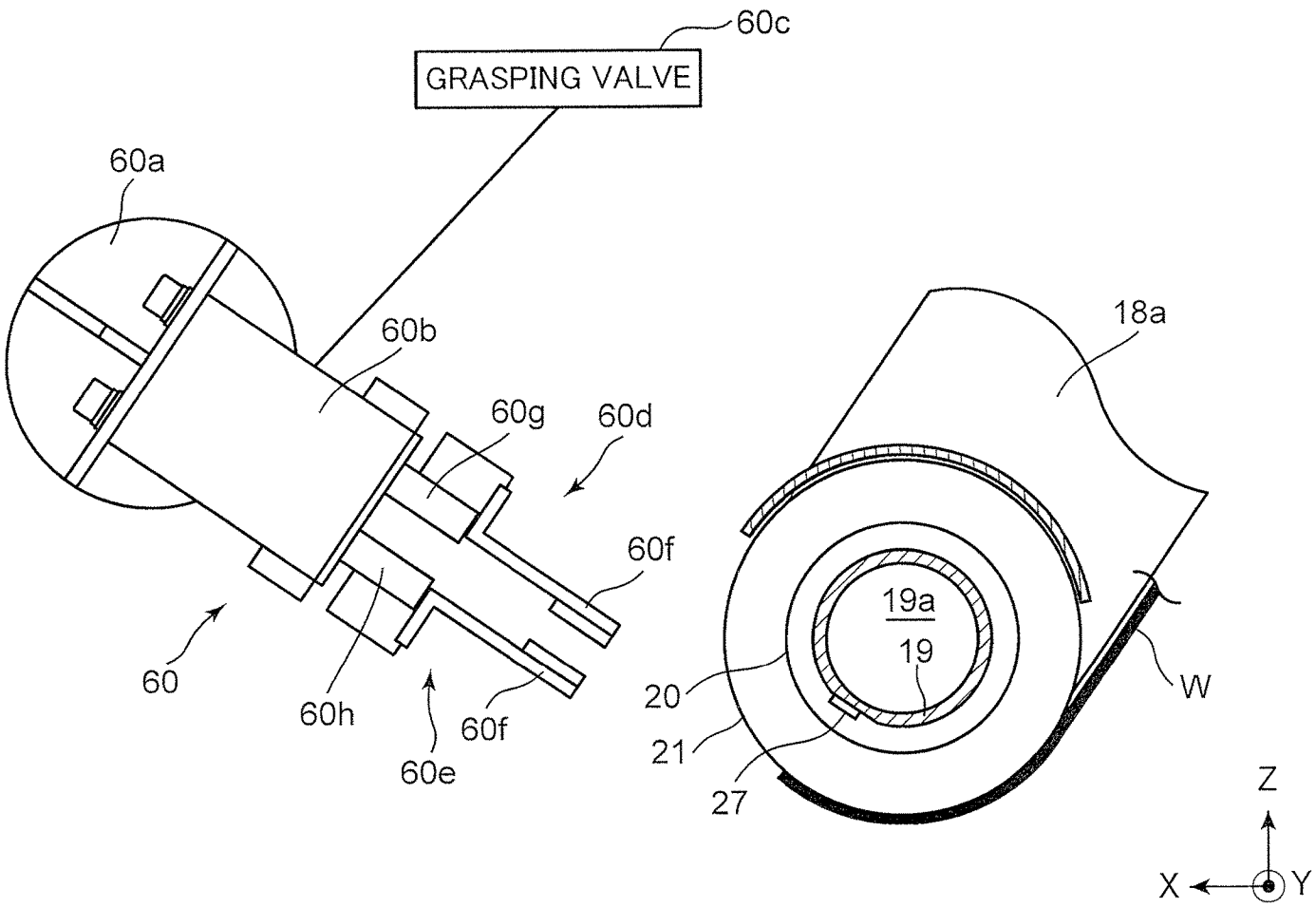
FIG. 7 is a sectional view taken along line VII-VII in FIG. 5.

The end section detector 27 is configured to detect a position of the end section of the sheet W of the original material roll R2 having been separated by the suction roller 21. Specifically, as shown in FIG. 7, the end section detector 27 is attached to the supporting shaft 19 at a position which is inside in a radial direction of outer peripheral surfaces of the two suction rollers 21 and which is between the two suction rollers 21.

The controller 70, to be described later, stops rotational driving of the original material roll R2 when the end section of the sheet W of the original material roll R2 is detected by the end section detector 27 and, in this state, the end section of the sheet W is grasped by a hand 60 of the operation robot 3. In other words, a position of the end section of the sheet W having been suctioned by the suction roller 21 and detected by the end section detector 27 corresponds to a sheet retrieval position for retrieving the sheet W from the original material roll R2. A sheet retrieval position is similarly set on the original material roll R2 or, in other words, the first end section retrieving unit 7A.

Referring to FIG. 1 and FIG. 2, the joining unit 8 is for joining, to an intermediate section of the sheet W being delivered from a delivery-side original material roll among the original material rolls R1 and R2 held by the roll holding unit 5, an end section of the sheet W of a standby-side original material roll that is a roll other than the delivery-side original material roll among the original material rolls R1 and R2 held by the roll holding unit 5. While each of the original material rolls R1 and R2 held by the roll holding unit 5 sequentially switches to a delivery-side original material roll and a standby-side original material roll in the sheet delivery system 1, in the following description, the original material roll R1 is assumed to be the delivery-side original material roll and the original material roll R2 is assumed to be the standby-side original material roll.

Figure 8:
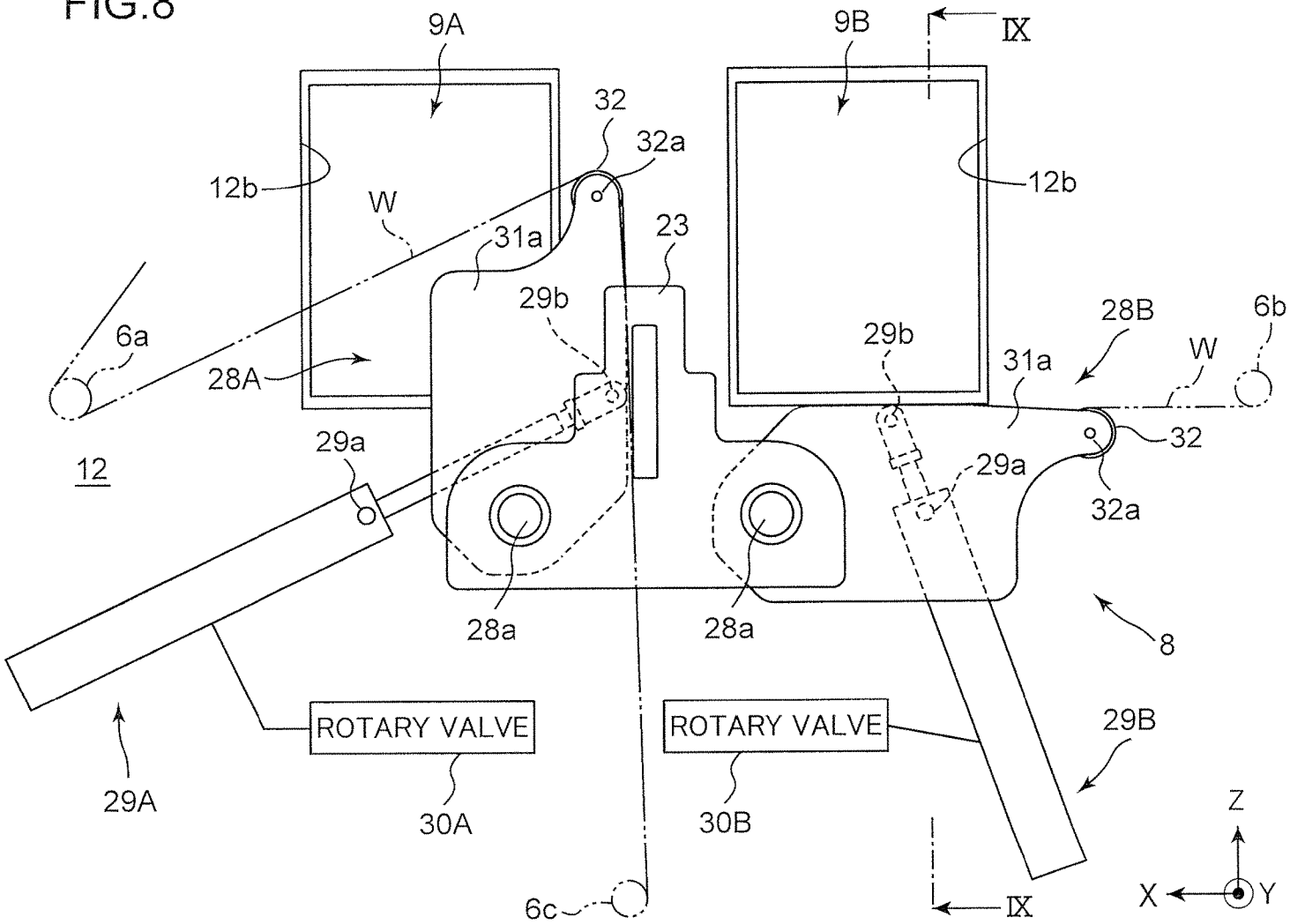
FIG. 8 is a front view showing an enlargement of a joining unit shown in FIG. 1.
Figure 9:
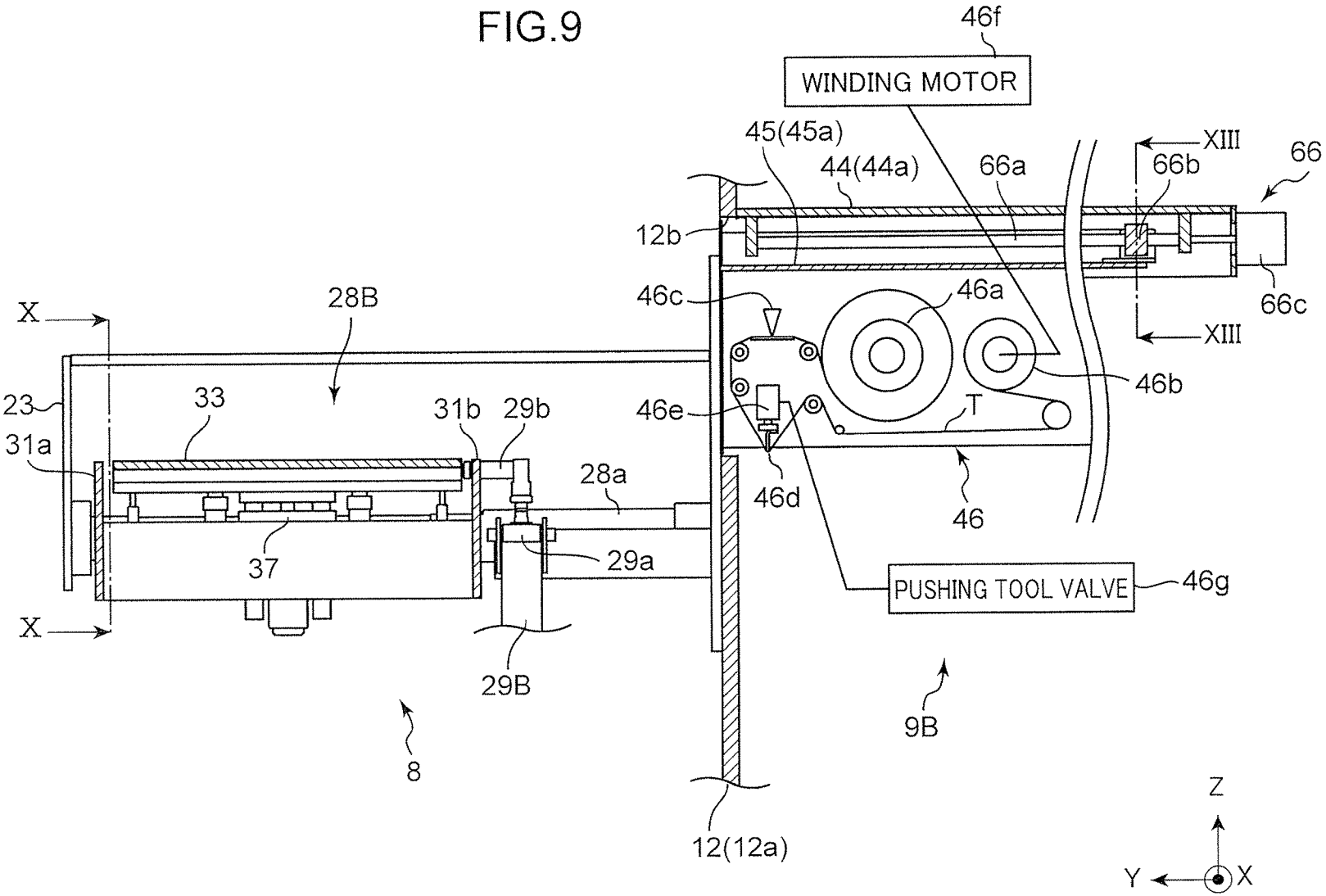
FIG. 9 is a sectional view taken along line IX-IX in FIG. 8 and shows a state where a tape affixing unit is moved to a retreated position.
Figure 10:
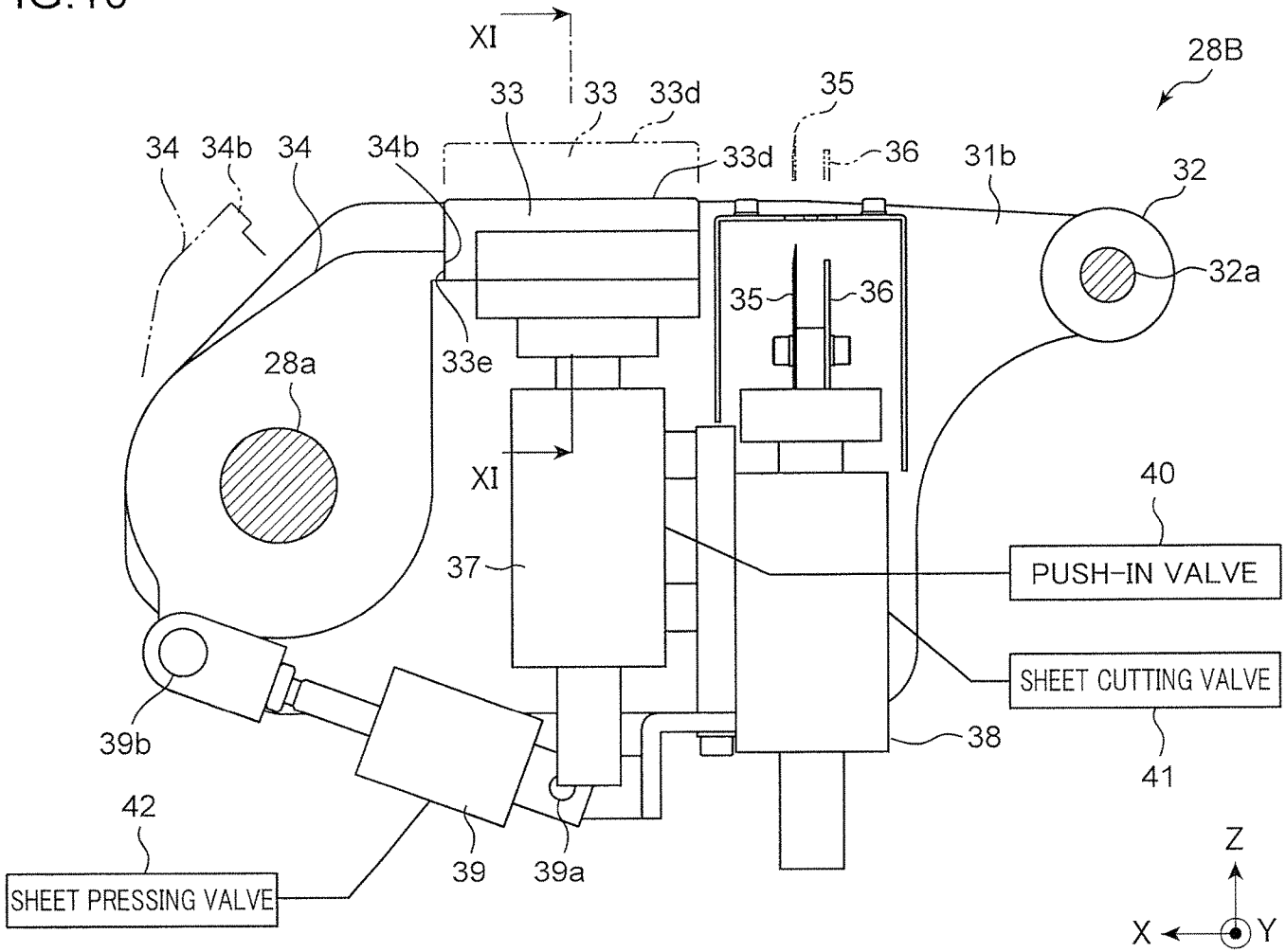
FIG. 10 is a sectional view taken along line X-X in FIG. 9.

Referring to FIG. 8 to FIG. 10, the joining unit 8 includes: a shaft supporting plate 23 which opposes the supporting plate 12 and which supports, between the shaft supporting plate 23 and the supporting plate 12, two shafts 28*a* extending in the Y direction; joining mechanisms 28A and 28B attached to the supporting plate 12 respectively in a state where the joining mechanisms 28A and 28B are rotatable around the shafts 28*a*; a rotary cylinder 29A which rotationally drives the joining mechanism 28A; a rotary cylinder 29B which rotationally drives the joining mechanism 28B; a rotary valve 30A which controls driving of the rotary cylinder 29A; and a rotary valve 30B which controls driving of the rotary cylinder 29B.

The joining mechanisms 28A and 28B are attached to the supporting plate 12 in a state where the joining mechanisms 28A and 28B are rotatable around the shaft 28*a* between a delivery position (a position of the joining mechanism 28A shown in FIG. 8) for delivering the sheet W along the guiding unit 6 in accordance with extension/contraction operations of the rotary cylinders 29A and 29B and a mounting position (a position of the joining mechanism 28B in FIG. 8) for mounting the end section of the sheet W to be joined to the intermediate section of the sheet W being delivered.

The rotary cylinders 29A and 29B include: a cylinder main body attached to the supporting plate 12 in a state where the cylinder main body is rotatable around a shaft 29*a* extending in the Y direction; and a rod attached to the joining mechanisms 28A and 28B (opposing plates 31*a* and 31*b* to be described later) in a state where the rod is rotatable around a shaft 29*b* extending in the Y direction. The joining mechanisms 28A and 28B rotate to the mounting position as the rod contracts with respect to the cylinder main body of the rotary cylinders 29A and 29B, and rotate to the delivery position as the rod extends from the cylinder main body of the rotary cylinders 29A and 29B.

The rotary valves 30A and 30B control extension/contraction operations of the rotary cylinders 29A and 29B by controlling supply of air to the rotary cylinders 29A and 29B and discharge of air from the rotary cylinders 29A and 29B.

Moreover, since the joining mechanisms 28A and 28B have configurations symmetrical in the X direction, the configuration of the joining mechanism 28B will be mainly described.

The joining mechanism 28B includes: opposing plates 31*a* and 31*b* which oppose each other in the Y direction; and a holding roller 32, a suction holding member 33, a pressing member 34, a cutting blade 35, a pressing blade 36, a push-in cylinder 37, a cutting cylinder 38, and a sheet pressing cylinder 39 provided between the opposing plates 31*a* and 31*b*.

The holding roller 32 is attached to the opposing plates 31*a* and 31*b* in a state where the holding roller 32 is rotatable around a rotary shaft 32*a* extending in the Y direction between both opposing plates 31*a* and 31*b*. In addition, the holding roller 32 is for supporting the sheet W between the support roller 6*b* and the support roller 6*c* (the holding roller 32 of the joining mechanism 28A holds the sheet W between the support roller 6*a* and the support roller 6*c*). Specifically, in the joining mechanism 28B having rotated to the mounting position, an upper end of the holding roller 32 of the joining mechanism 28B is arranged at an approximately same height position as a lower end of the support roller 6*b*, and the sheet W guided to the holding roller 32 from the support roller 6*b* is arranged approximately horizontally. On the other hand, in the joining mechanism 28A having rotated to the delivery position, the holding roller 32 of the joining mechanism 28A is arranged above the support roller 6*a*. Accordingly, the sheet W is guided upward from the support roller 6*a* toward the holding roller 32 and guided downward from the holding roller 32 toward the support roller 6*c*.

Figure 11:
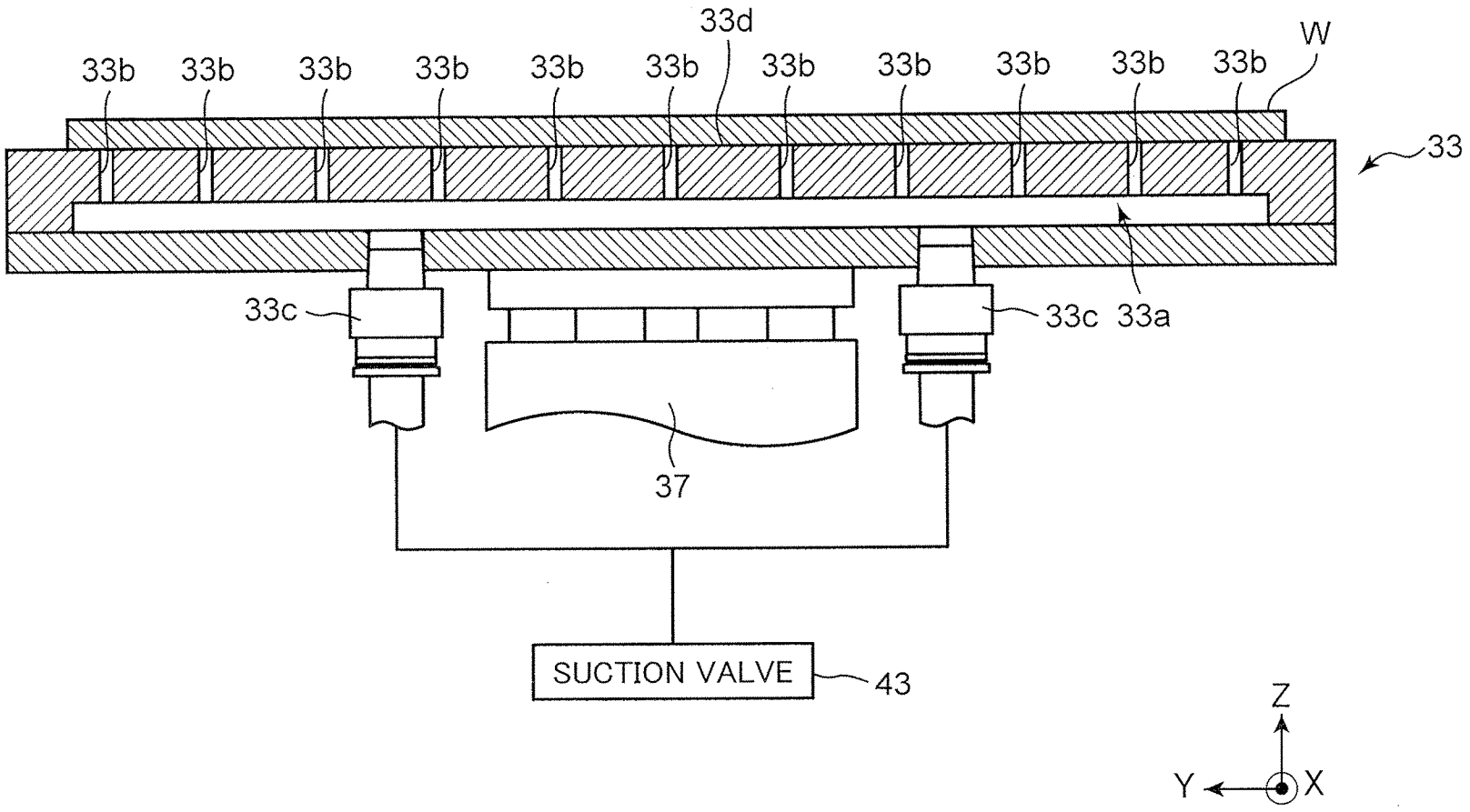
FIG. 11 is a sectional view taken along line XI-XI in FIG. 10.

Referring to FIG. 10 and FIG. 11, the suction holding member 33 includes a suction surface 33*d* configured to suction the end section of the sheet W. Specifically, the suction holding member 33 includes: a decompression chamber 33*a* provided inside the suction holding member 33; a through-hole 33*b* which penetrates a side wall including a suction surface 33*d* and which opens the decompression chamber 33*a* to the outside of the decompression chamber 33*a*; and a pipe 33*c* which is provided on a side wall on an opposite side to the suction surface 33*d* and which communicates with the decompression chamber 33*a*. The pipe 33*c* is connected to a suction source (not shown) via a suction valve 43. Therefore, by opening the suction valve 43, air inside the decompression chamber 33*a* is sucked out to enable the suction surface 33*d* to suction the sheet W.

Figure 23:
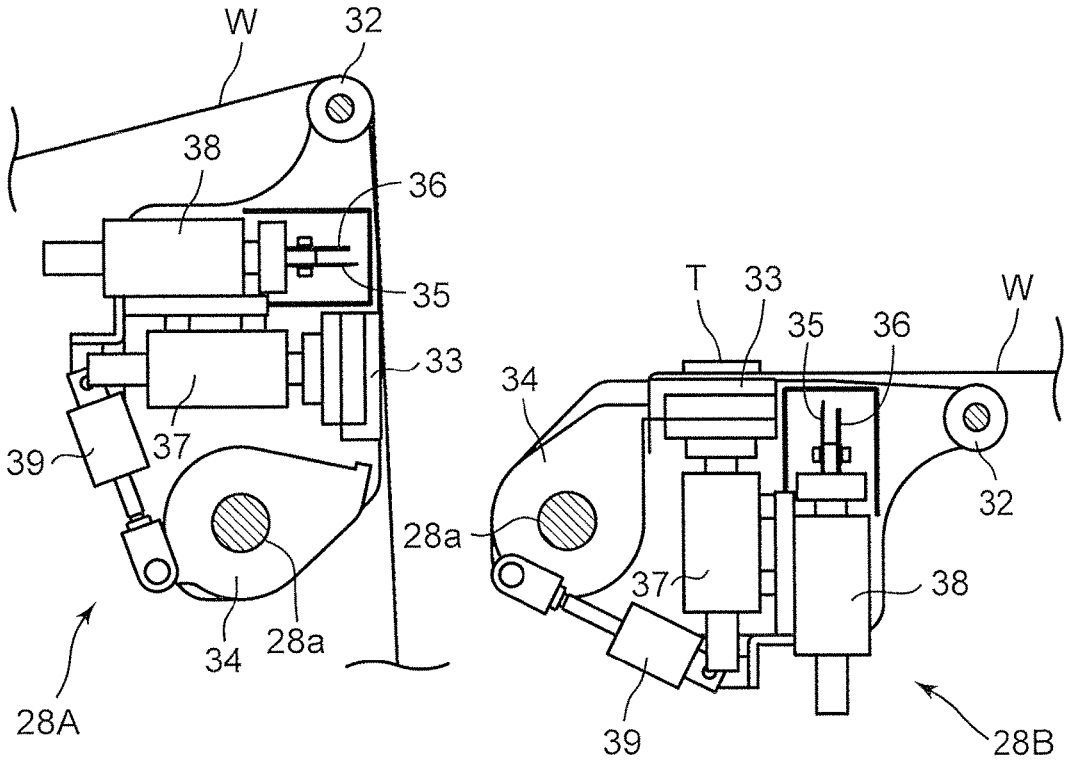
FIG. 23 is a front view showing an operation of a joining unit in a state where a tip section of a sheet is pressed by a pressing member.
Figure 24:
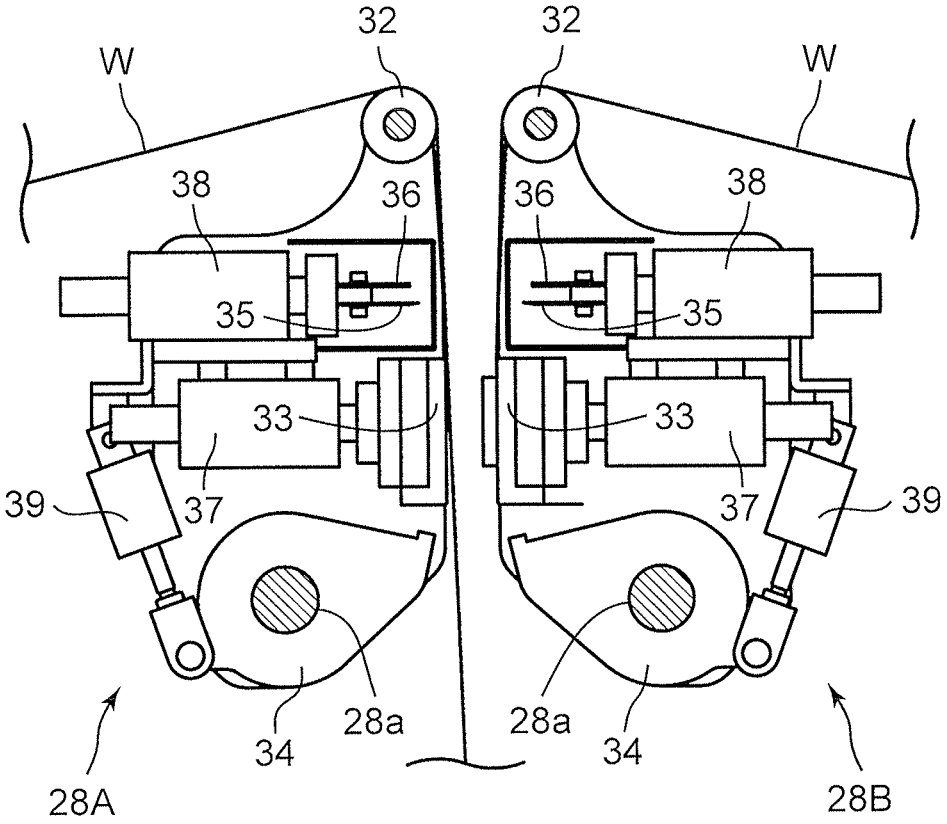
FIG. 24 is a front view showing an operation of a joining unit in a state where a standby-side joining mechanism is moved toward a delivery-side joining mechanism.

In this case, the suction holding member 33 is provided between the shaft 28*a* and the holding roller 32. In addition, the suction holding member 33 is attached to the opposing plates 31*a* and 31*b* so that the suction surface 33*d* is arranged approximately parallel to a YZ plane (refer to FIG. 24) in a state where the joining mechanism 28B is rotated to the delivery position and that the suction surface 33*d* is arranged approximately parallel to an XY plane in a state where the joining mechanism 28B is rotated to the mounting position. Therefore, when the sheet W of the original material roll R2 is placed on the suction surface 33*d* in a state where the joining mechanism 28B is rotated to the mounting position as shown in FIG. 23 and, in this state, the joining mechanism 28B is rotated to the delivery position as shown in FIG. 24, the suction surface 33*d* of the suction holding member 33 moves toward the intermediate section (the joining mechanism 28A) of the sheet W of the delivery-side original material roll R1 while applying tension to the sheet W between the original material roll R2 and the suction holding member 33. In other words, the shaft 28*a*, the opposing plates 31*a* and 31*b*, the rotary cylinders 29A and 29B, and the rotary valves 30A and 30B correspond to a moving mechanism in which the suction surface 33*d* is movable toward the intermediate section of the delivery-side original material roll R1 or R2 along a path set in advance so that tension is applied to the sheet W between the original material rolls R1 and R2 and the suction holding member 33.

Furthermore, as indicated by a solid line and a chain double-dashed line in FIG. 10, the suction holding member 33 is attached to the opposing plates 31*a* and 31*b* so that the suction surface 33*d* can move reciprocally in a direction perpendicular to the suction surface 33*d* in accordance with extension/contraction operations of the push-in cylinder 37. Specifically, the push-in cylinder 37 includes: a cylinder main body fixed to both opposing plates 31*a* and 31*b*; and a rod which is extendable/contractible with respect to the cylinder main body, and a tip section of the rod is fixed to the suction holding member 33. A push-in valve 40 which controls extension/contraction operations of the push-in cylinder 37 by controlling supply of air to the push-in cylinder 37 and discharge of air from the push-in cylinder 37 is connected to the push-in cylinder 37.

The pressing member 34 includes a pressing surface 34*b* which presses a tip section of the sheet W between the pressing member 34 and a pressed surface 33*e* of the suction holding member 33. In this case, the pressed surface 33*e* is a side surface of the suction holding member 33 extending from an edge of the suction surface 33*d* in an opposite direction to a direction to which the suction surface 33*d* faces.

Specifically, the pressing member 34 is attached to the opposing plates 31*a* and 31*b* so as to be rotatable with respect to the opposing plates 31*a* and 31*b* around the shaft 28*a* between a restricted position (a position indicated by the solid line in FIG. 10) at which the tip section of the sheet W is sandwiched between the pressed surface 33*e* and the pressing surface 34*b* and an allowable position (a position indicated by the chain double-dashed line in FIG. 10) at which the pressing surface 34*b* is separated from the pressed surface 33*e* in accordance with extension/contraction operations of the sheet pressing cylinder 39. The sheet pressing cylinder 39 includes: a cylinder main body attached to the opposing plates 31*a* and 31*b* in a state where the cylinder main body is rotatable around a shaft 39*a* extending in the Y direction; and a rod which is extendable/contractible with respect to the cylinder main body and which is attached to the pressing member 34 in a state where the rod is rotatable around a shaft 39*b* extending in the Y direction. A sheet pressing valve 42 which controls extension/contraction operations of the sheet pressing cylinder 39 by controlling supply of air to the sheet pressing cylinder 39 and discharge of air from the sheet pressing cylinder 39 is connected to the sheet pressing cylinder 39.

In other words, the opposing plates 31*a* and 31*b*, the shafts 39*a* and 39*b*, the sheet pressing cylinder 39, and the sheet pressing valve 42 correspond to a pressing driving mechanism which drives the pressing member 34 so that the pressing surface 34*b* approaches and retreats from the pressed surface 33*e*. In addition, the pressing driving mechanism corresponds to a regulating mechanism that is configured to switch between a regulated state (a restricted position) in which a movement of the end section of the sheet W with respect to the suction holding member 33 due to the tension is regulated and an allowable state in which the movement of the end section of the sheet W with respect to the suction holding member 33 is allowed. In this case, as shown in FIG. 23, the pressing member 34 sandwiches (restrains) only the tip section of the sheet W between the pressing member 34 and the suction holding member 33.

The cutting blade 35 and the pressing blade 36 are for cutting the sheet W provided between the suction holding member 33 and the holding roller 32. Specifically, as indicated by a solid line and a chain double-dashed line in FIG. 10, the cutting blade 35 and the pressing blade 36 are attached to the opposing plates 31*a* and 31*b* so that the cutting blade 35 and the pressing blade 36 can move reciprocally in a direction parallel to a direction of reciprocal operations of the suction holding member 33 in accordance with extension/contraction operations of the cutting cylinder 38. The cutting cylinder 38 includes: a cylinder main body fixed to the opposing plates 31*a* and 31*b*; and a rod which is extendable/contractible with respect to the cylinder main body and to which the cutting blade 35 and the pressing blade 36 are fixed. A sheet cutting valve 41 which controls extension/contraction operations of the cutting cylinder 38 by controlling supply of air to the cutting cylinder 38 and discharge of air from the cutting cylinder 38 is connected to the cutting cylinder 38.

Figure 12:
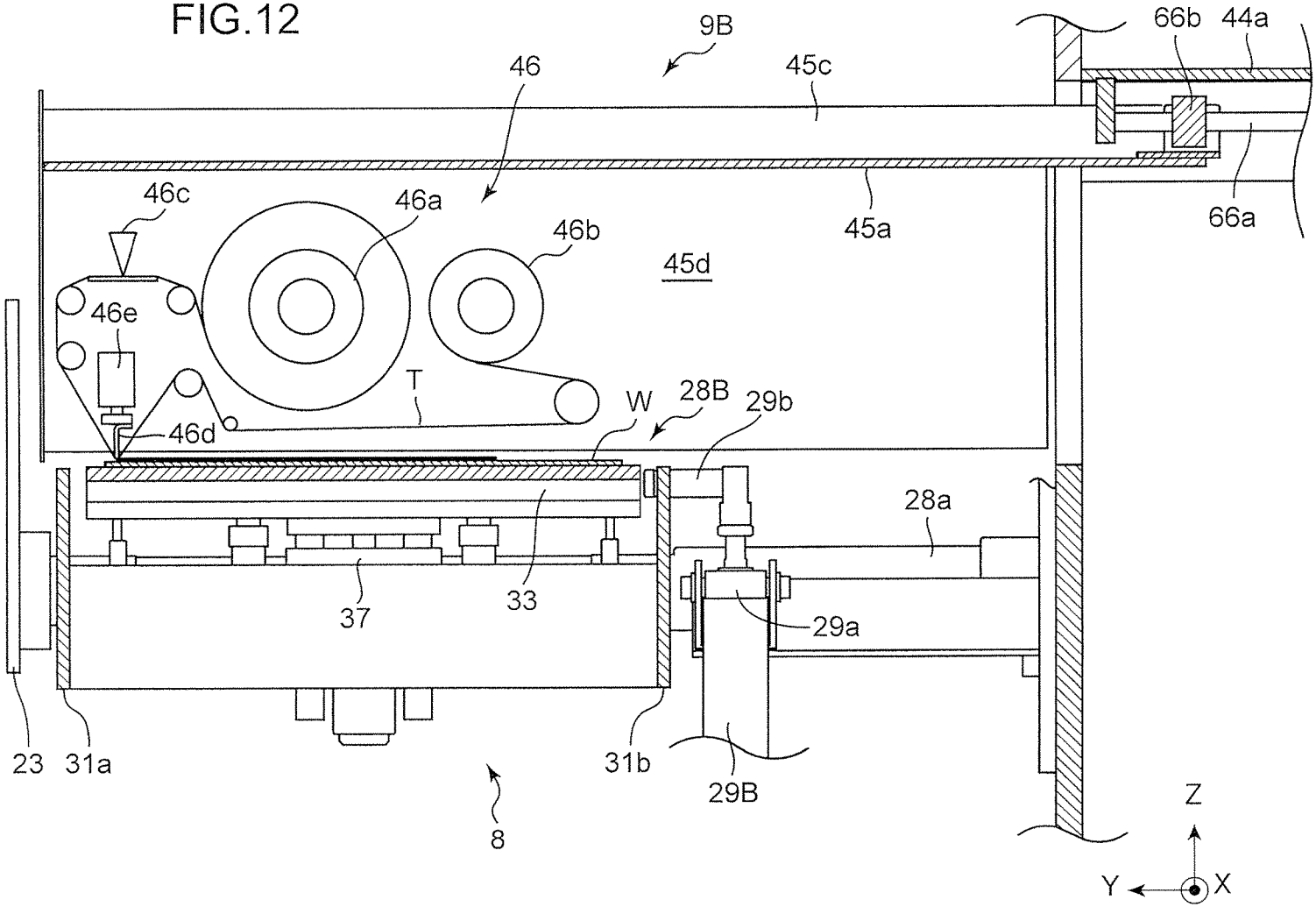
FIG. 12 corresponds to a sectional view taken along line IX-IX in FIG. 8 and shows a state where a tape affixing unit is moved to a tape attaching position.

Referring to FIG. 8, FIG. 9, and FIG. 12, the tape affixing unit 9A is for affixing a tape T (an adhesive) to the end section of the sheet W held by the suction holding member 33 of the joining mechanism 28A, and the tape affixing unit 9B is for affixing the tape T to the end section of the sheet W held by the suction holding member 33 of the joining mechanism 28B. Since the tape affixing units 9A and 9B have configurations symmetrical in the X direction, only the tape affixing unit 9B will be described and a description of the tape affixing unit 9A will be omitted.

The tape affixing unit 9B includes: a fixed frame 44 which is fixed to the supporting plate 12; a moving frame 45 which is attached to the fixed frame 44 so as to be movable in the Y direction; a driving mechanism 66 which drives the moving frame 45; and a tape attaching mechanism (an adhesive attaching mechanism) 46 which is attached to the moving frame 45.

Figure 13:
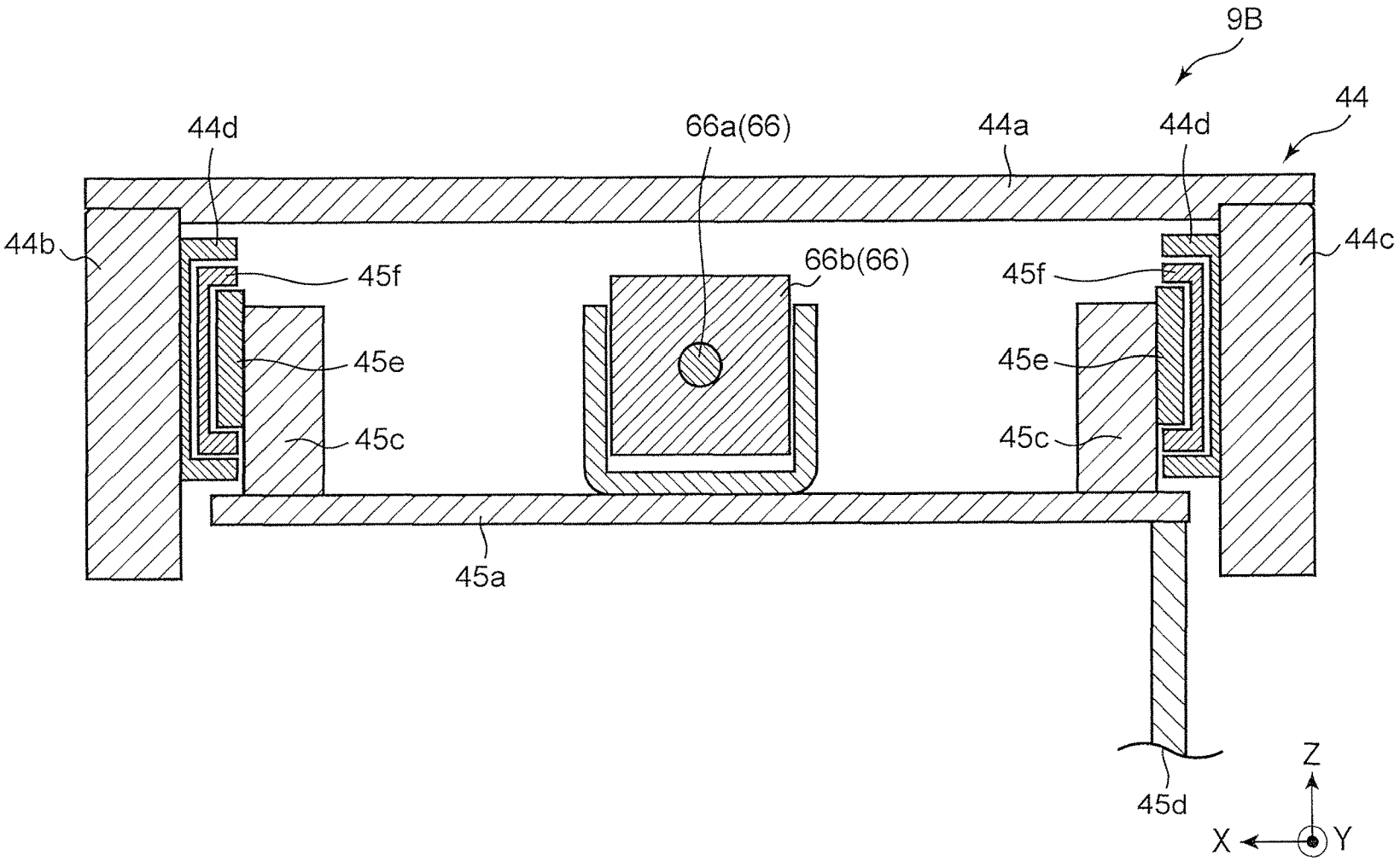
FIG. 13 is a sectional view taken along line XIII-XIII in FIG. 9.

Referring to FIG. 9, FIG. 12, and FIG. 13, the fixed frame 44 includes: a top plate 44*a* extending from the supporting plate 12 toward an opposite side to the joining unit 8 in the Y direction; side plates 44*b* and 44*c* extending downward from both end sections of the top plate 44*a* in the X direction; and a rail 44*d* which is fixed to surfaces of the side plates 44*b* and 44*c* opposing each other and which extends in the Y direction.

The moving frame 45 is attached to the fixed frame 44 so as to be movable between a position (a position shown in FIG. 12) at which the moving frame 45 protrudes from the supporting plate 12 toward a side of the joining mechanism 28B through the through-hole 12*b* penetrating the supporting plate 12 in the Y direction and a position (a position shown in FIG. 9) at which the moving frame 45 is retreated to a rear side of the supporting plate 12 through the through-hole 12*b* from a movement path (a rotation path) of the joining mechanism 28B so as to allow a movement (a rotation) of the joining mechanism 28B.

Specifically, the moving frame 45 includes: a base plate 45*a*; side plates 45*b* and 45*c* erected on both end sections in the X direction of the base plate 45*a*; a supporting plate 45*d* extending downwardly from one end section in the X direction of the base plate 45*a*; a slider 45*e* which is fixed to surfaces of the side plates 45*b* and 45*c* facing respectively opposite sides; and a slide rail 45*f* which engages with the slider 45*e*. The slider 45*e* engages the slide rail 45*f* so as to be slidable in the Y direction, and the slide rail 45*f* engages the rail 44*d* so as to be slidable in the Y direction.

The driving mechanism 66 includes: a ball screw 66*a* attached to the fixed frame 44 in a state where the ball screw 66*a* is rotatable around an axis along the Y direction; a nut 66*b* which is screwed by the ball screw 66*a* and which is fixed to the moving frame 45 (the base plate 45*a*); and a moving motor 66*c* which rotationally drives the ball screw 66*a*. As the ball screw 66*a* is rotated by the moving motor 66*c*, the nut 66*b* and the moving frame 45 being fixed to the nut 66*b* move in the Y direction.

The tape attaching mechanism 46 is for attaching the tape T to the end section of the sheet W suctioned by the suction surface 33*d* of the joining mechanism 28B.

In addition, the tape attaching mechanism 46 is attached to the supporting plate 45*d* of the moving frame 45. Therefore, due to driving by the moving motor 66*c*, the tape attaching mechanism 46 is configured to move between a tape attaching position (a position shown in FIG. 12) at which the tape attaching mechanism 46 opposes the suction surface 33*d* in order to attach the tape T to the end section of the sheet W and a retreated position (a position shown in FIG. 9) at which the tape attaching mechanism 46 is retreated from a movement path (a rotation path) of the suction holding member 33 so as to allow a movement (a rotation) of the suction holding member 33. In other words, the fixed frame 44, the moving frame 45, and the driving mechanism 66 correspond to a movement supporting mechanism which supports the tape attaching mechanism 46 so as to be movable between the tape attaching position and the retreated position.

Specifically, the tape attaching mechanism 46 includes: a delivery roller 46*a* which holds a roll formed by winding the tape T is wound in a state where delivery of the tape T is allowed; a winding roller 46*b* which takes up a release paper of the tape T; a cutting blade 46*c* which cuts only an adhesive layer of the tape T; a pushing tool 46*d* which presses the adhesive layer of the tape T against the sheet W; a pushing tool cylinder 46*e* which drives the pushing tool 46*d* in the Z direction; a winding motor 46*f* which rotationally drives the winding roller 46*b*; and a pushing tool valve 46*g* which controls driving of the pushing tool cylinder 46*e*.

When attaching the adhesive layer of the tape T to the sheet W, in a process of moving the tape attaching mechanism 46 from the retreated position to the tape attaching position, the winding motor 46*f* is driven to drive the pushing tool cylinder 46*e* and the tape T is pressed against the side of the sheet W with the pushing tool 46*d*. Accordingly, a partial range of the adhesive layer (in the drawing, the adhesive layer is also denoted by reference character T for the sake of convenience) of the tape T having been cut by the cutting blade 46*c* is attached onto the sheet W.

Referring to FIG. 1 and FIG. 2, the operation robot 3 retrieves the end section of the sheet W from the standby-side original material roll R2 and conveys the end section of the sheet W to the joining unit 8. In particular, the operation robot 3 is configured to convey the end section of the sheet W to the joining unit 8 from each of two sheet retrieval positions (positions of the end section of the sheet W suctioned by the suction roller 21) set in the sheet delivery system 1. Therefore, the end section of the sheet W can be conveyed from both original material rolls R1 and R2 to the joining unit 8 without changing holding positions of the original material rolls R1 and R2 being held by the roll holding unit 5.

Specifically, the operation robot 3 includes: a robot main body 47 which conveys the end section of the sheet W; and a moving mechanism 48 which supports the robot main body 47 so as to be movable in the X direction.

The robot main body 47 includes: a movable body 54 which is movably supported by the moving mechanism 48; and a multi-jointed arm 55 provided on the movable body 54.

The multi-jointed arm 55 includes: a turning section 56 attached to the movable body 54 in a state where the turning section 56 is turnable around a turning axis J1 along the Z axis direction; a first arm 57 attached to the turning section 56 in a state where the first arm 57 is swingable around a first horizontal direction axis J2; a second arm 58 attached to the first arm 57 in a state where the second arm 58 is swingable around a second horizontal direction axis J3; a third arm 59 attached to the second arm 58 in a state where the third arm 59 is rotatable around a third horizontal direction axis J4; and a hand 60 attached to the third arm 59 in a state where the hand 60 is swingable around an axis J5 that is perpendicular to the third axis J4.

In addition, the multi jointed arm 55 includes: a first motor 61 which turnably drives the turning section 56 with respect to the movable body 54; a second motor 62 which drives the first arm 57 with respect to the turning section 56; a third motor 63 which drives the second arm 58 with respect to the first arm 57; a fourth motor 64 which rotationally drives the third arm 59 with respect to the second arm 58; and a fifth motor 65 which drives the hand 60 with respect to the third arm 59.

Referring to FIG. 5 and FIG. 7, the hand 60 corresponds to a grasping unit or a sheet holding unit configured to grasp the end section of the sheet W of the original material rolls R1 and R2. The hand 60 includes: an extending section 60*a* which extends from the third arm 59; a pair of grasping actuators 60*b* provided on a tip section of the extending section 60*a*; grasping units 60*d* and 60*e* attached to the grasping actuators 60*b*; a plurality of grasping claws 60*f* provided on the grasping units 60*d* and 60*e*; and a grasping valve 60*c* which controls driving of the grasping actuators 60*b*.

The grasping actuators 60*b* include: an actuator main body (reference symbol omitted); and a pair of driving units 60*g* and 60*h* which protrude from the actuator main body. The pair of driving units 60*g* and 60*h* approach each other as air is supplied to the actuator main body and separate from each other as air is discharged from the actuator main body. The grasping valve 60*c* is configured to control supply of air to the grasping actuators 60*b* and discharge of air from the grasping actuators 60*b*.

The grasping unit 60*d* is attached to the driving unit 60*g*. On the other hand, the grasping unit 60*e* is attached to the driving unit 60*h*.

Figure 18:
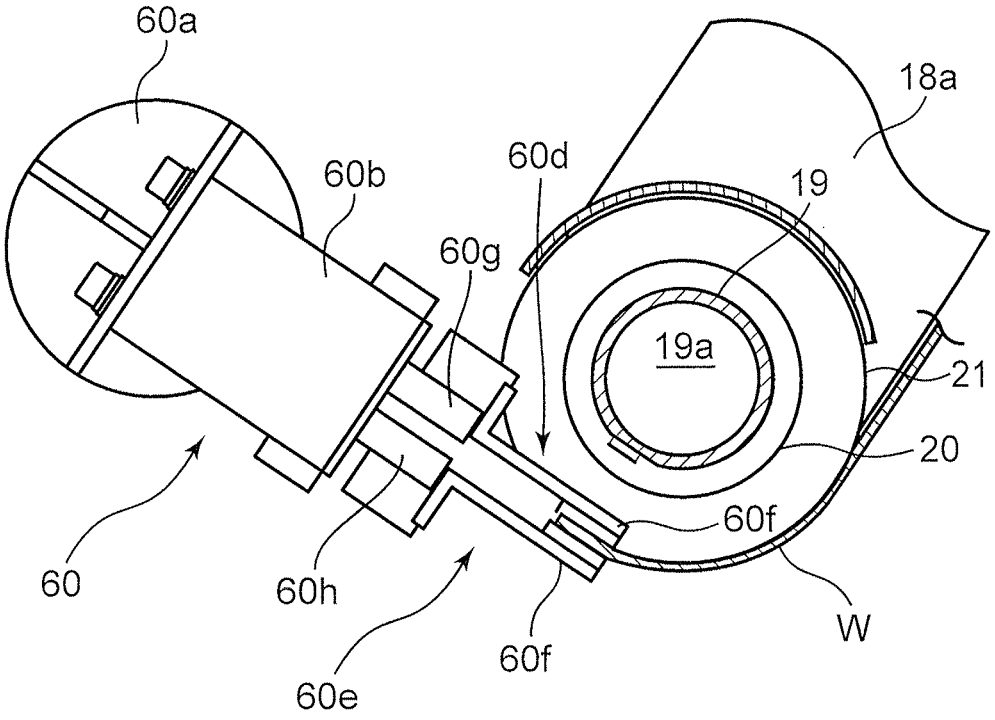
FIG. 18 is a side sectional view showing an operation of an operation robot in a state where a sheet is grasped at an end section retrieving unit.

As shown in FIG. 5, the grasping claws 60*f* are arranged at a same pitch as a pitch of spaces between adjacent suction rollers 21. In addition, each of the grasping claws 60*f* has a size and shape that enables the grasping claws 60*f* to be inserted to the spaces between adjacent suction rollers 21. Furthermore, the grasping claw 60*f* provided on the grasping unit 60*d* and the grasping claw 60*f* provided on the grasping unit 60*e* oppose each other. Therefore, as shown in FIG. 18, in a state where the grasping claw 60*f* is inserted between suction rollers 21, the end section of the sheet W suctioned by the suction rollers 21 can be grasped by the grasping claw 60*f*.

In other words, in the multi-jointed arm 55, the turning section 56, the arms 57 to 59, and the motors 61 to 65 correspond to a supporting mechanism which supports the hand 60 in a state where the hand 60 is movable within a movement range set in advance.

On the other hand, the moving mechanism 48 shown in FIG. 1 movably supports the supporting mechanism between an operating position (a position indicated by a chain double-dashed line in FIG. 3) at which the joining unit 8 and a retrieval position (the suction roller 21) of the sheet W with respect to the original material rolls R1 and R2 is within the movement range of the supporting mechanism and a standby position (a position indicated by a solid line in FIG. 3) at which the supporting mechanism is separated from the joining unit 8 as compared to the operating position.

Figure 3:
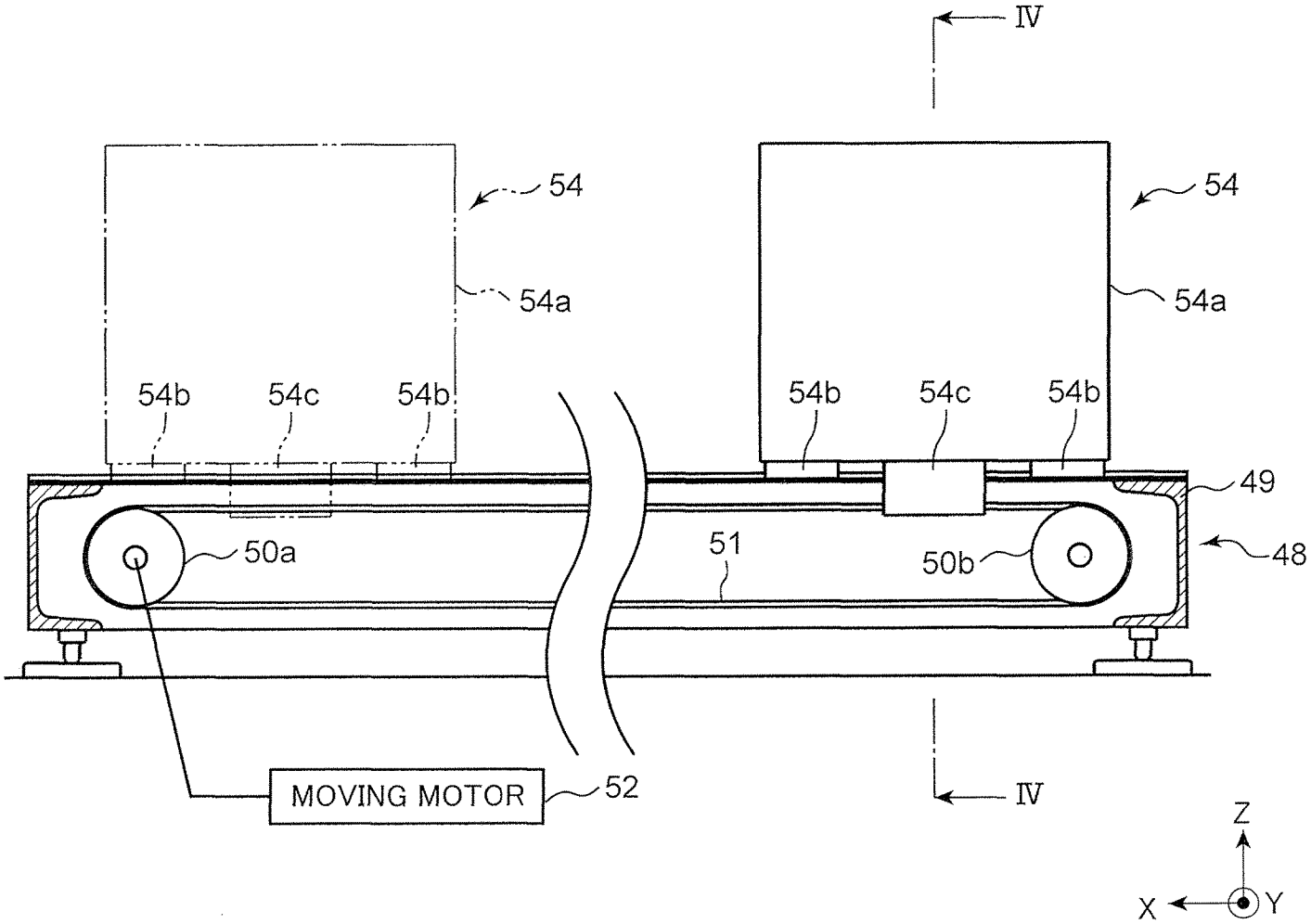
FIG. 3 is a schematic diagram showing an enlargement of a part of an operation robot shown in FIG. 1.
Figure 4:
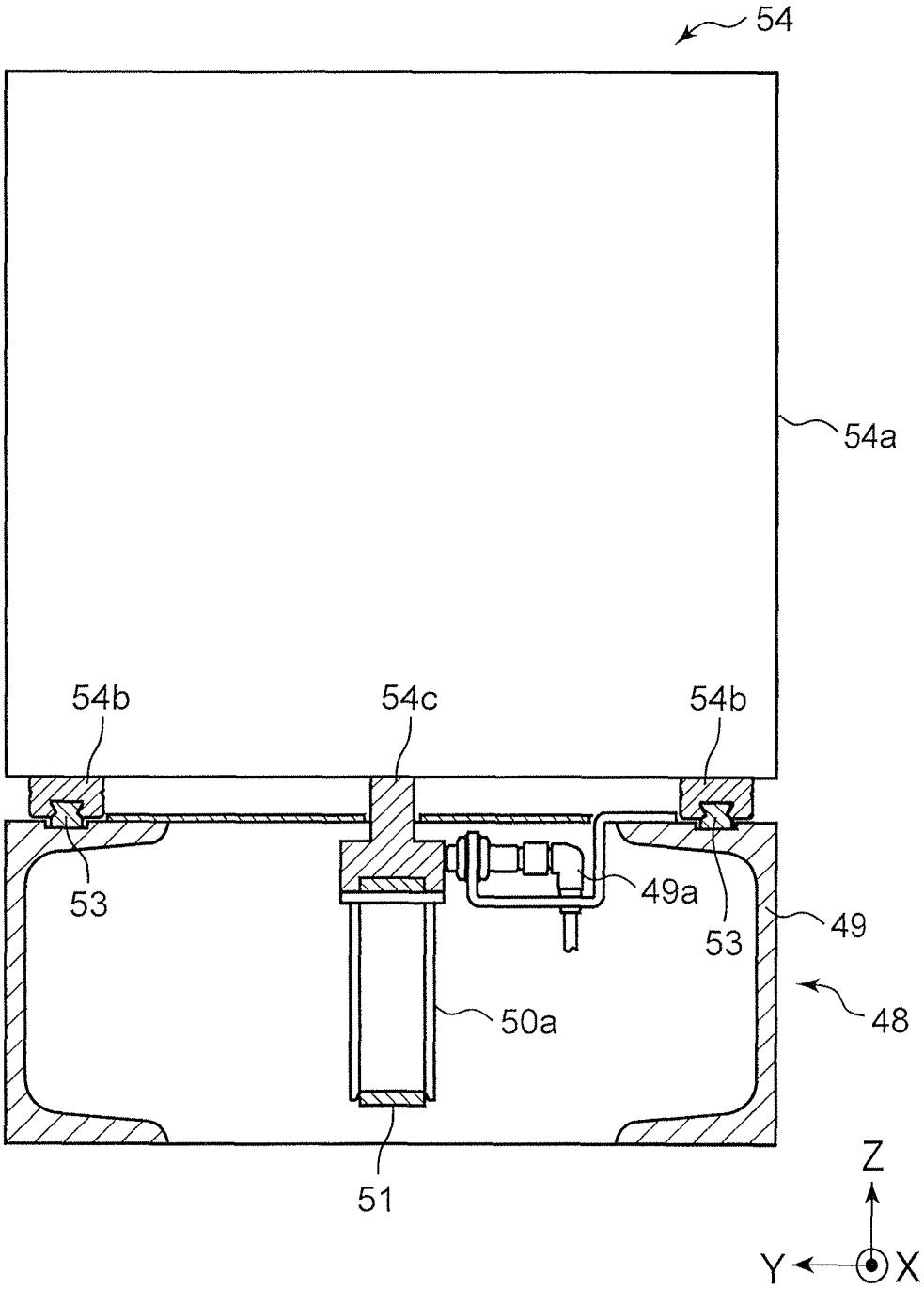
FIG. 4 is a sectional view taken along line IV-IV in FIG. 3.

Specifically, as shown in FIG. 3 and FIG. 4, the moving mechanism 48 includes: a main body unit 49; a pair of pulleys 50*a* and 50*b* rotatably supported around an axis along the Y direction with respect to the main body unit 49; a belt 51 provided between the pulleys 50*a* and 50*b*; a moving motor 52 which rotationally drives the pulley 50*a*; and a rail 53 (refer to FIG. 4) fixed to the main body unit 49.

On the other hand, the movable body 54 of the robot main body 47 includes: a movable body main body 54*a* provided on the main body unit 49; a slider 54*b* which is fixed to a lower surface of the movable body main body 54*a* and which engages the rail 53 in a state where the slider 54*b* is slidable in the X direction; and a fixed section 54*c* which is fixed to a part of the belt 51 positioned between both pulleys 50*a* and 50*b*.

When the pulley 50*a* is rotated by the moving motor 52, in accordance with a movement of the part of the belt 51 positioned between both pulleys 50*a* and 50*b*, the fixed section 54*c* which is fixed thereto moves in the X direction. As a result, the slider 54*b* slides relative to the rail 53 and, accordingly, the movable body main body 54*a* fixed to the slider 54*b* and the robot main body 47 supported by the movable body main body 54*a* move in the X direction.

In addition, the main body unit 49 of the moving mechanism 48 includes: a standby position detector 49*a* (refer to FIG. 4) configured to detect that the robot main body 47 (the movable body 54) is moved to the standby position; and an operating position detector 49*b* (refer to FIG. 14) configured to detect that the robot main body 47 is moved to the operating position. Both detectors 49*a* and 49*b* are respectively configured to detect whether or not the fixed section 54*c* of the movable body 54 has reached a position corresponding to the standby position or whether or not the fixed section 54*c* has reached a position corresponding to the operating position.

Moreover, a portion of the operation robot 3 other than the hand 60 corresponds to a holding unit driving mechanism which drives the hand 60.

Figure 14:
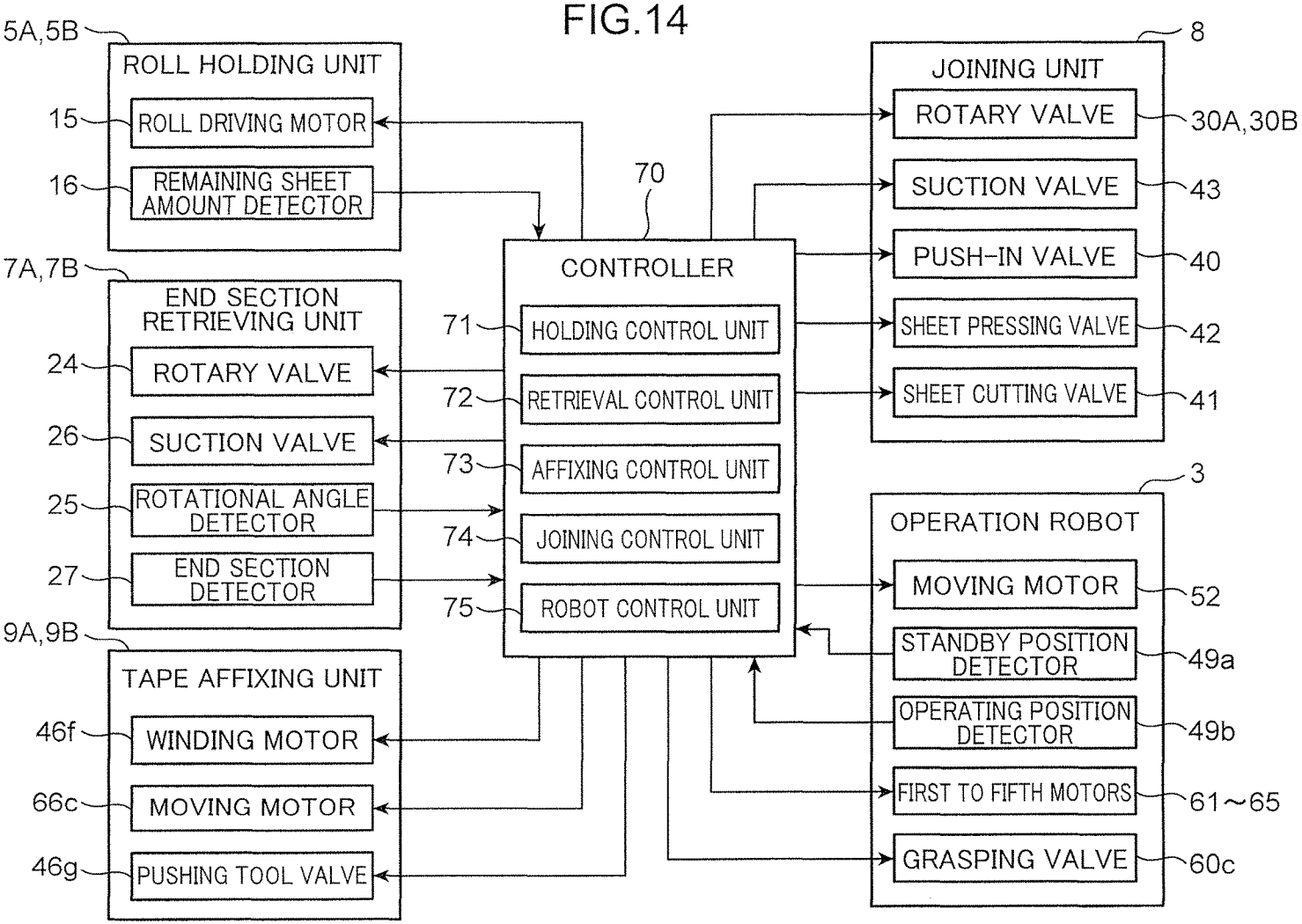
FIG. 14 is a block diagram showing an electric configuration of the sheet delivery system shown in FIG. 1.

Referring to FIG. 1 and FIG. 14, the controller 70 controls driving of the roll holding units 5A and 5B, the end section retrieving units 7A and 7B, the joining unit 8, the tape affixing units 9A and 9B, and the operation robot 3 based on results of detections by the remaining sheet amount detector 16, the rotational angle detector 25, the end section detector 27, the standby position detector 49*a*, and the operating position detector 49*b*.

Specifically, the controller 70 includes: a holding control unit 71 which controls driving of the roll holding units 5A and 5B; a retrieval control unit 72 which controls driving of the end section retrieving units 7A and 7B; an affixing control unit 73 which controls driving of the tape affixing units 9A and 9B; a joining control unit 74 which controls driving of the joining unit 8; and a robot control unit 75 which controls driving of the operation robot 3.

The holding control unit 71 starts driving of the roll driving motor 15 when the remaining sheet amount detector 16 detects that a remaining roll amount of the delivery-side original material roll R1 is smaller than a remaining amount set in advance. On the other hand, the holding control unit 71 stops the roll driving motor 15 when the end section detector 27 detects an end section of the standby-side original material roll R2 on the suction roller 21.

The retrieval control unit 72 controls driving of the rotary valve 24 so that the suction roller 21 comes into contact with the original material rolls R1 and R2 based on results of detections by the remaining sheet amount detector 16 and the rotational angle detector 25.

When a position of the suction roller 21 is changed in accordance with a remaining amount of the sheet W of the original material rolls R1 and R2 in this manner, a retrieval position of the sheet W by the operation robot 3 changes in accordance with the change.

Figure 17:
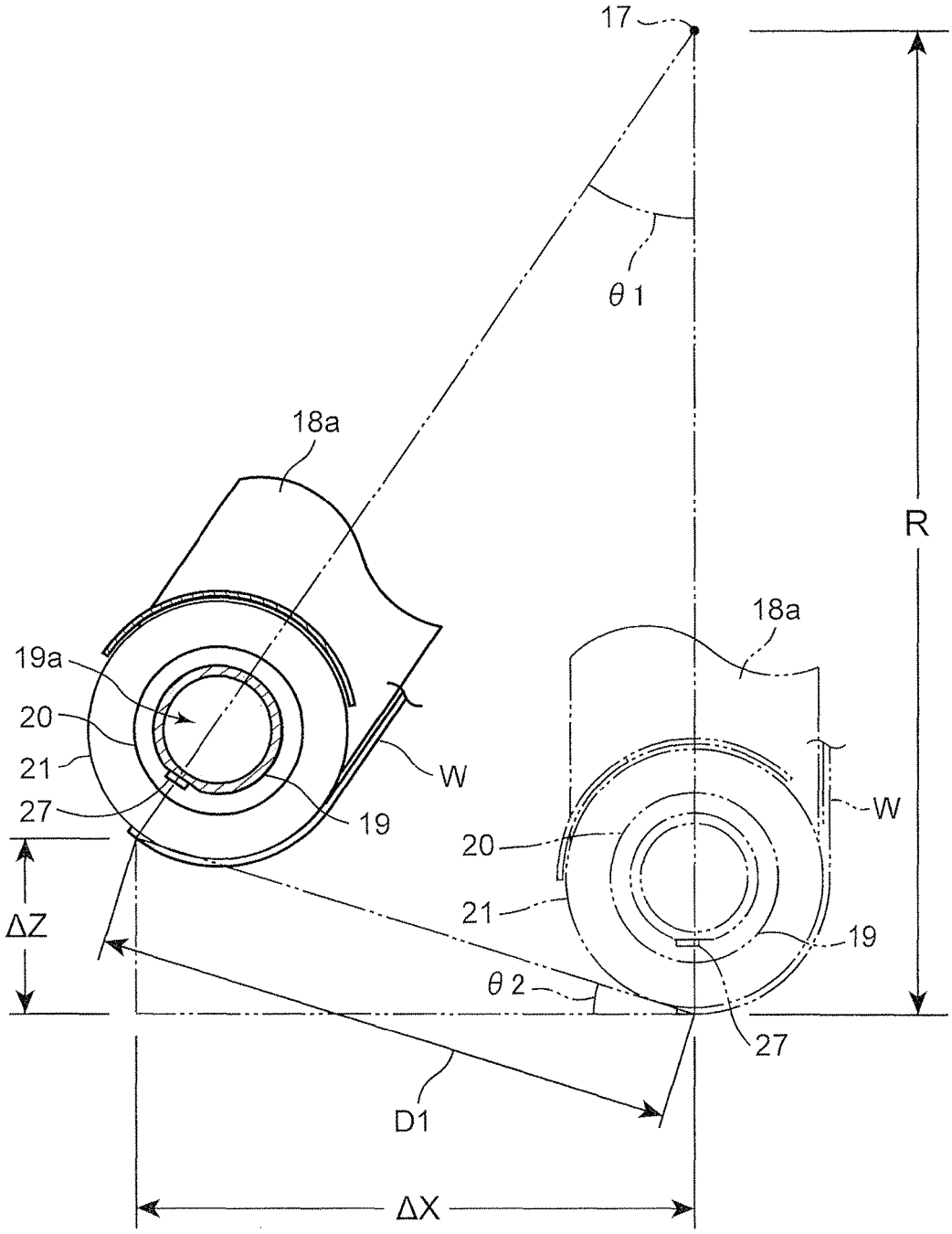
FIG. 17 is a schematic diagram for explaining a method of calculating an amount of variation of a position of an end section of a sheet by the controller shown in FIG. 14.

Therefore, as shown in FIG. 17, the retrieval control unit 72 calculates an amount of variation of a position of an end section of the sheet W with respect to a reference position (for example, a position indicated by a chain double-dashed line in FIG. 17) set in advance, based on a positional relationship (a radius of rotation R) between the rotary shaft 17 and the end section detector 27 and rotational angles of the arms 18*a* and 18*b* detected by the rotational angle detector 25.

Specifically, the retrieval control unit 72 calculates a movement distance D1 based on an angular difference θ1 between a reference position and a current position of the arms 18*a* and 18*b* and the radius of rotation R. In addition, the retrieval control unit 72 calculates an amount of variation ΔX in the X direction and an amount of variation ΔZ in the Z direction based on an angular difference θ2 with respect to the X direction of a movement direction of the arms 18*a* and 18*b* from the reference position to the current position and the movement distance D1.

Furthermore, the retrieval control unit 72 separates the sheet W from the original material rolls R1 and R2 using the suction roller 21 by opening the suction valve 26 at a timing set in advance.

The robot control unit 75 controls the moving motor 52 based on results of detections by the standby position detector 49*a* and the operating position detector 49*b* so that the robot main body 47 moves to the standby position in a situation where the sheet W is being delivered from one of the original material rolls R1 and R2 and that the robot main body 47 moves to the operating position in a situation where a joining operation of the sheet W is required.

In addition, the robot control unit 75 controls the first to fifth motors 61 to 65 so that the hand 60 moves toward a sheet retrieval position calculated by the retrieval control unit 72, and controls the grasping valve 60*c* so that the sheet W suctioned by the suction roller 21 is grasped by the hand 60 as shown in FIG. 18.

Figure 19:
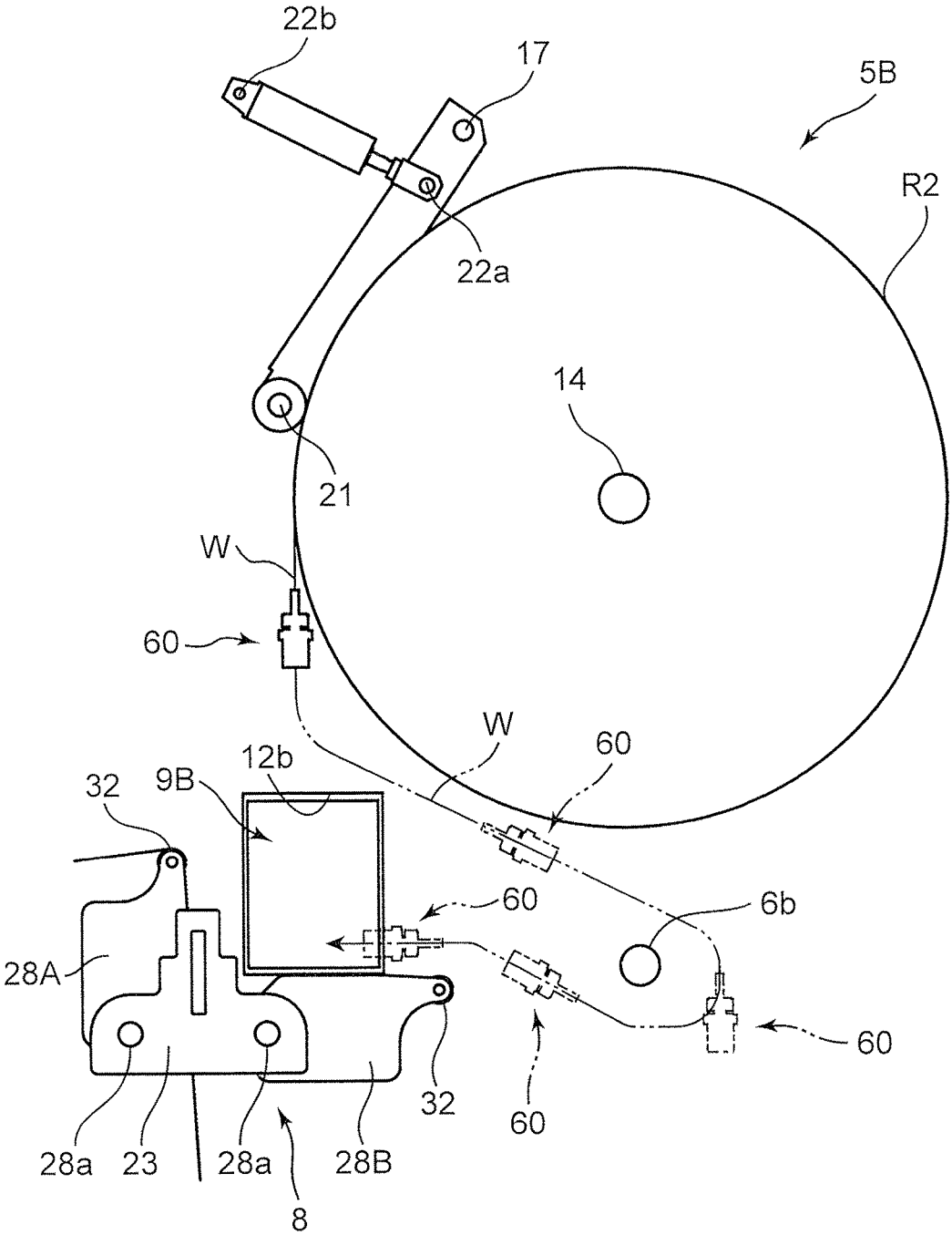
FIG. 19 is a front view showing an operation of an operation robot and showing a trajectory of movement of a sheet by a hand.

Furthermore, as shown in FIG. 19, the robot control unit 75 controls driving of the first to fifth motors 61 to 65 so that the hand 60 grasping the sheet W moves along a path which passes above, to the right, and below the support roller 6*b* and which reaches the joining mechanism 28B.

Figure 20:
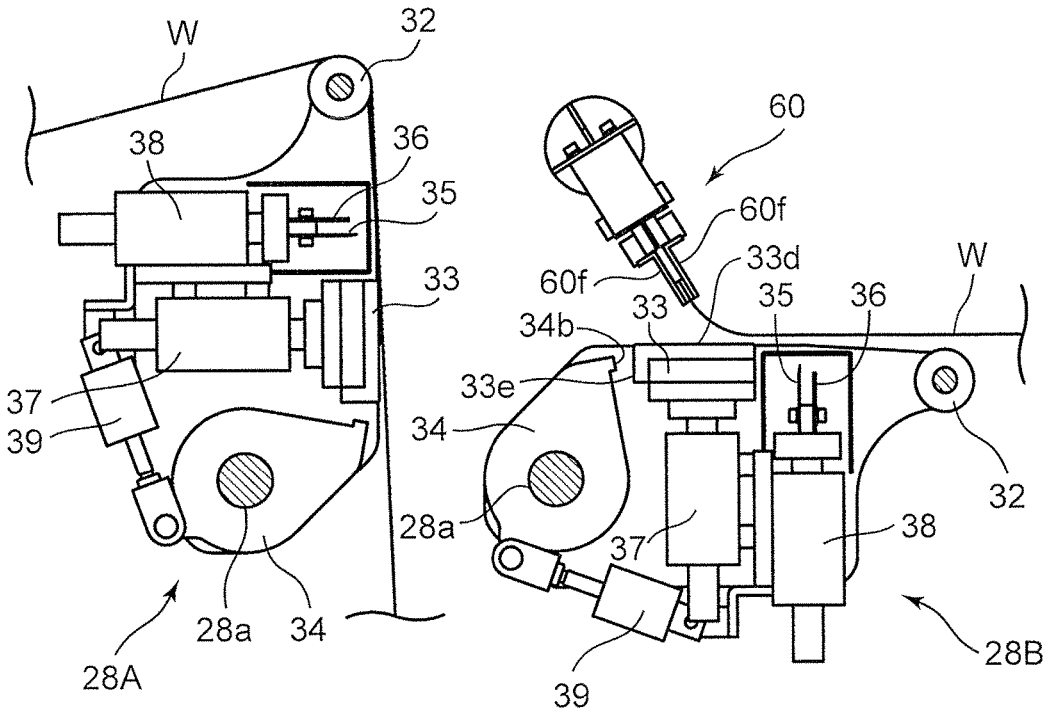
FIG. 20 is a front view showing an operation of an operation robot in a state where a sheet is guided to a suction holding member.
Figure 21:
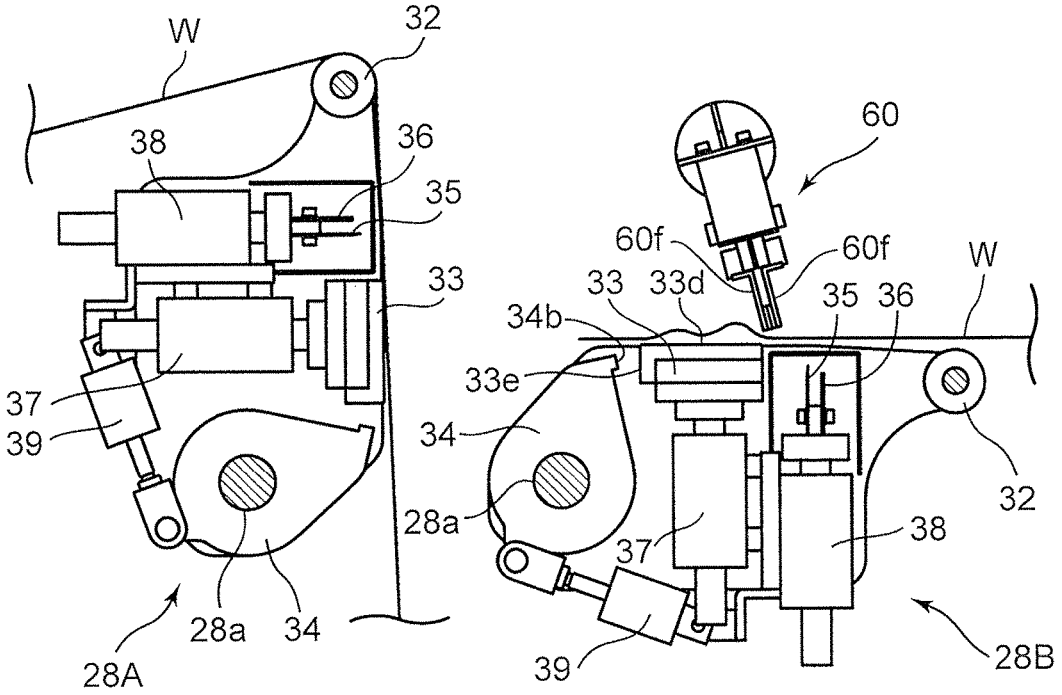
FIG. 21 is a front view showing an operation of an operation robot in a state where a sheet is placed on a suction holding member.
Figure 22:
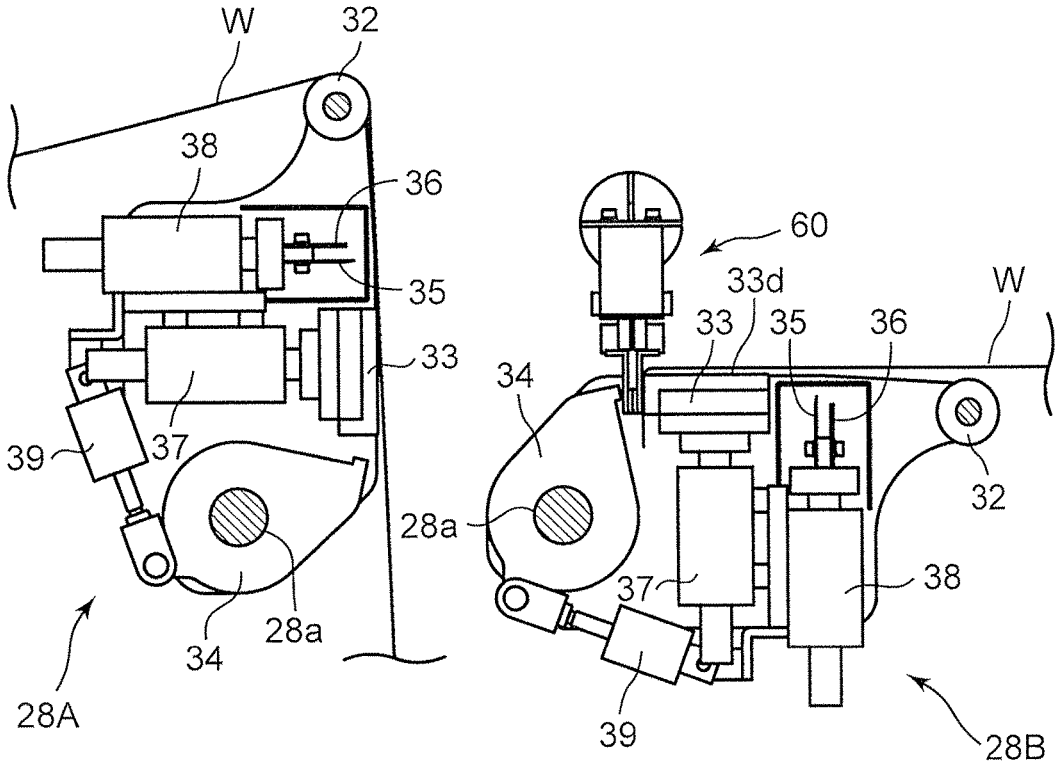
FIG. 22 is a front view showing an operation of an operation robot in a state where a sheet on a suction holding member is smoothed and a tip section of the sheet is pushed inward.

Moreover, as shown in FIG. 20 to FIG. 22, the robot control unit 75 controls the first to fifth motors 61 to 65 and the grasping valve 60*c* so that the hand 60 places the end section of the sheet W on the suction surface 33*d* of the suction holding member 33, the hand 60 releases its hold on the end section of the sheet W, and the hand 60 further rubs the end section of the sheet W placed on the suction surface 33*d* along the suction surface 33*d*.

In this case, as shown in FIG. 21 and FIG. 22, the robot control unit 75 controls the first to fifth motors 61 to 65 and the grasping valve 60*c* so that the hand 60 places the end section of the sheet W on the suction surface 33*d* so that the tip section of the sheet W exceeds an edge of the suction surface 33*d* and is arranged outside of the suction surface 33*d*, the hand 60 releases its hold on the end section of the sheet W, and the hand 60 further pushes the tip section of the sheet W along the pressed surface 33*e* so that the tip section of the sheet W bends along the pressed surface 33*e*.

Figure 27:
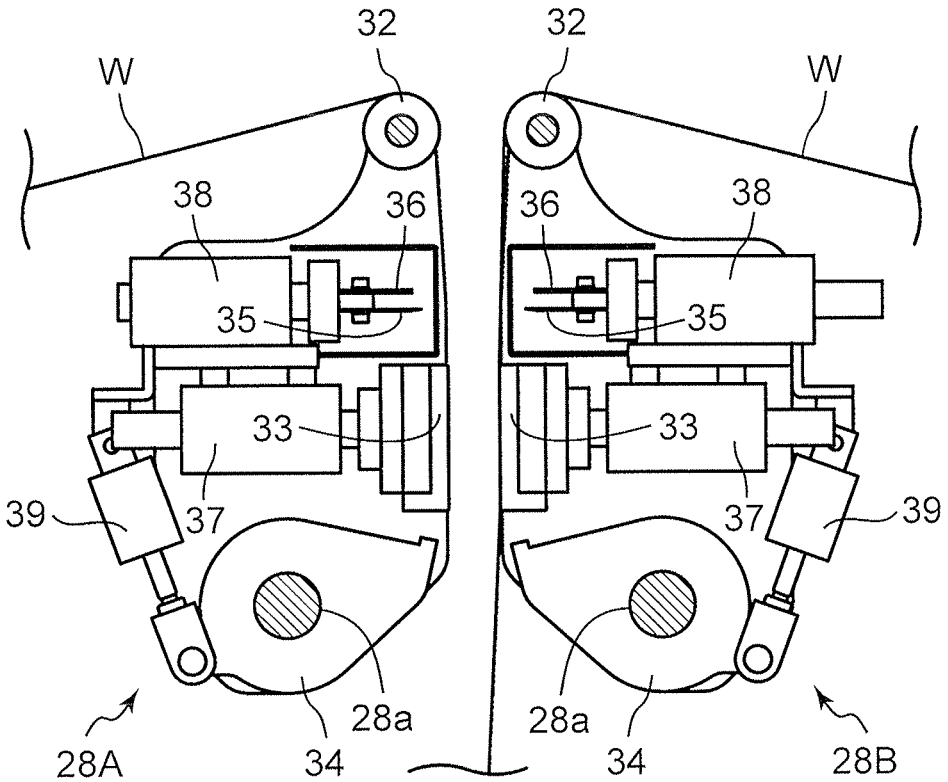
FIG. 27 is a front view showing an operation of a joining unit in a state where delivery of a sheet of a standby-side original material roll is started.

The joining control unit 74 controls the rotary valves 30A and 30B so that, as shown in FIG. 27, the joining mechanisms 28A and 28B are arranged at the delivery position during a delivery period of the sheet W of one of the original material rolls R1 and R2. On the other hand, when a joining operation is required, as shown in FIG. 19, the joining control unit 74 controls the rotary valve 30B so that the joining mechanism 28B is arranged at the mounting position in order to mount the end section of the sheet W of the standby-side original material roll R2 and, at the same time, opens the suction valve 43 to enable the sheet W to be suctioned by the suction surface 33*d*.

In addition, after the tip section of the sheet W is bent along the pressed surface 33*e* by the hand 60 as shown in FIG. 22, the joining control unit 74 controls the sheet pressing valve 42 so that the tip section of the sheet W is sandwiched between the pressed surface 33*e* and the pressing member 34 as shown in FIG. 23. Although details will be provided later, in this state, the tape T is affixed to the end section of the sheet W on the suction surface 33*d*. Furthermore, the joining control unit 74 continues pressing the tip section of the sheet W at least while the joining mechanism 28B moves from the mounting position to the delivery position.

Figure 25:
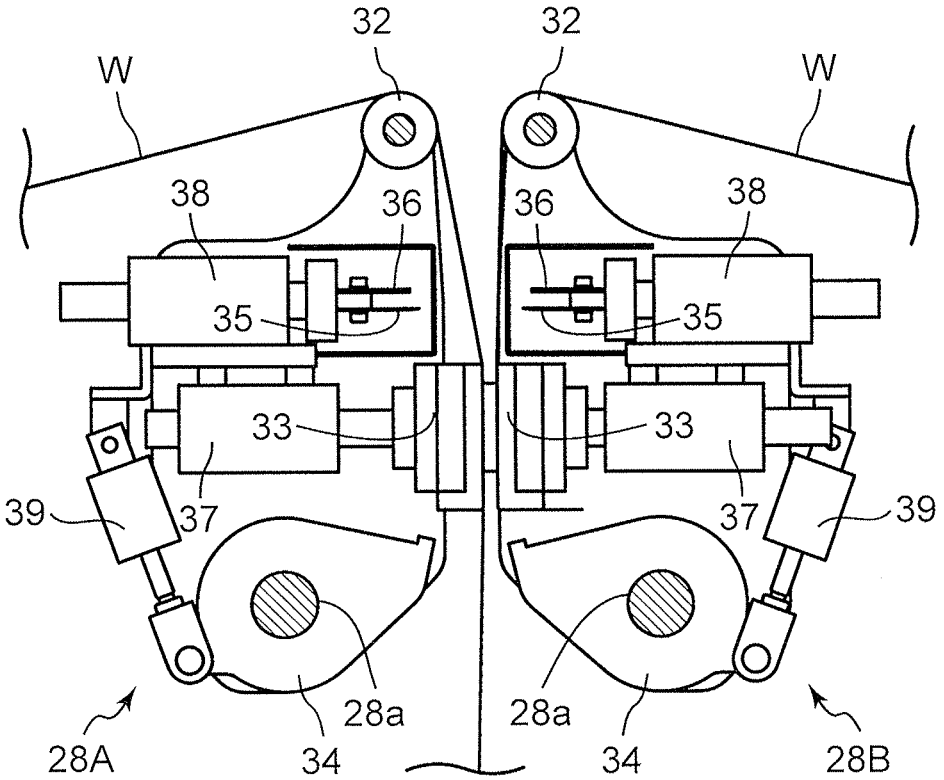
FIG. 25 is a front view showing an operation of a joining unit in a state where a sheet of a delivery-side original material roll is joined to a sheet of a standby-side original material roll via a tape.

Moreover, the joining control unit 74 controls the rotary valve 30B so that the joining mechanism 28B moves from the mounting position to the delivery position as shown in FIG. 24, and controls the push-in valve 40 so that the suction holding member 33 of the joining mechanism 28A approaches the suction holding member 33 of the joining mechanism 28B as shown in FIG. 25. Accordingly, the sheet W of the delivery-side original material roll R1 and the sheet W of the standby-side original material roll R2 are joined via the tape T.

Figure 26:
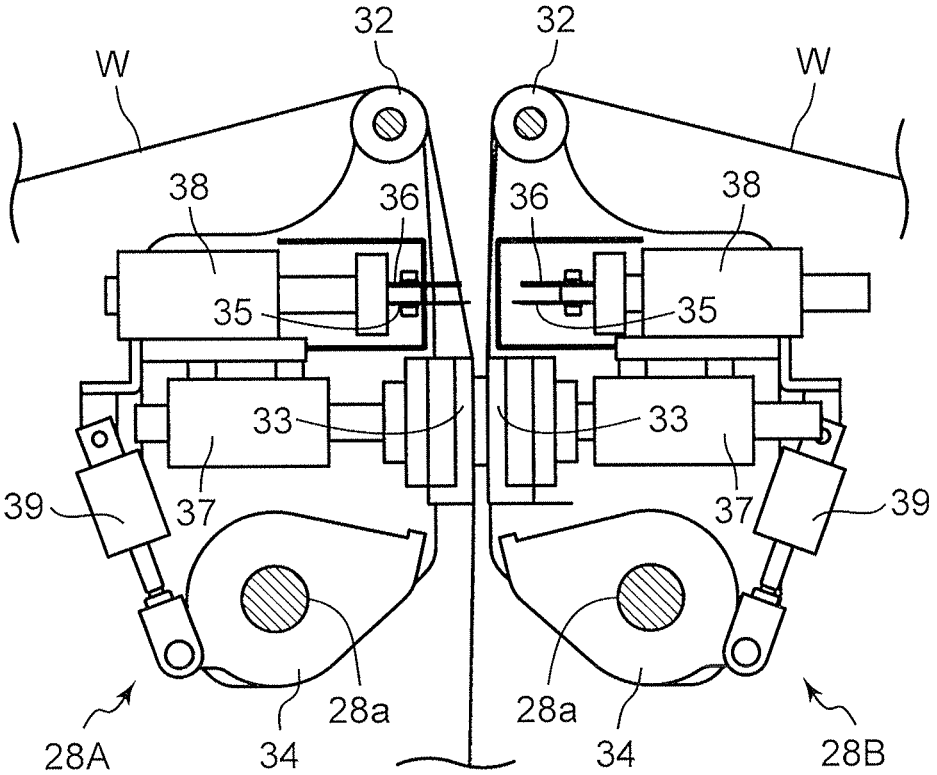
FIG. 26 is a front view showing an operation of a joining unit in a state where a sheet of a delivery-side original material roll is to be cut.

In this state, as shown in FIG. 26, the joining control unit 74 controls the sheet cutting valve 41 so that the cutting blade 35 and the pressing blade 36 of the joining mechanism 28A are projected toward a side of the joining mechanism 28B. Accordingly, the sheet W of the delivery-side original material roll R1 is cut.

The affixing control unit 73 controls the moving motor 66*c* so that, in a state where the joining mechanism 28B is rotated to the mounting position as shown in FIG. 23, the tape attaching mechanism 46 is positioned at the tape attaching position as shown in FIG. 12 and, before the joining mechanism 28B rotates to the delivery position, the tape attaching mechanism 46 is positioned at the retreated position.

In addition, the affixing control unit 73 controls the winding motor 46*f* and the pushing tool valve 46*g* so that the adhesive layer of the tape T is attached to the sheet W by taking up the release paper of the tape T and pushing the pushing tool 46*d* toward the side of the sheet W during the movement of the tape attaching mechanism 46 to the tape attaching position.

Figure 15:
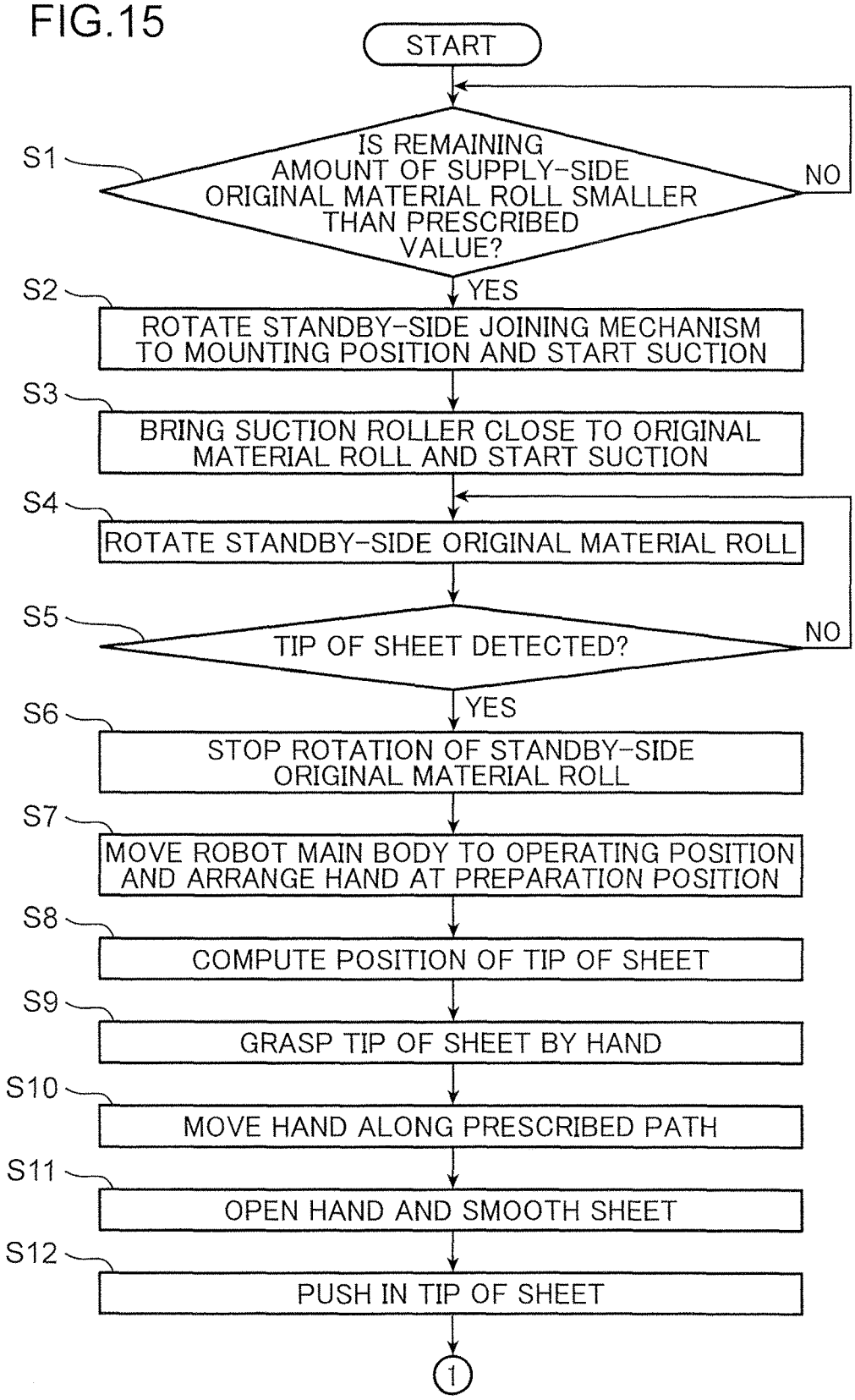
FIG. 15 is a flow chart showing a first half portion of a process executed by a controller shown in FIG. 14.
Figure 16:
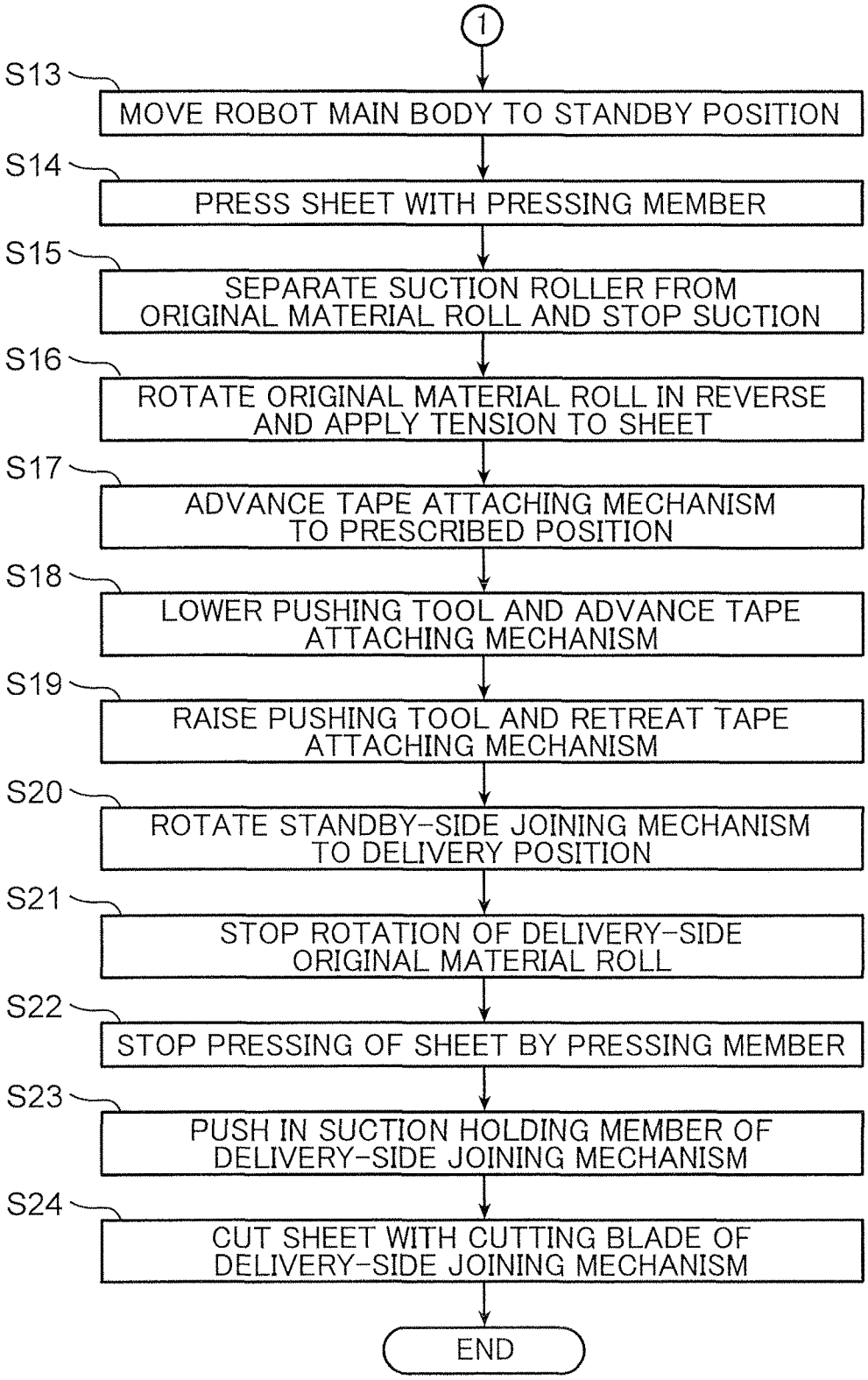
FIG. 16 is a flow chart showing a second half portion of the process executed by the controller shown in FIG. 14.

Hereinafter, a process executed by the controller 70 will be described with reference to FIG. 15 and FIG. 16.

The process by the controller 70 is started in a state where both joining mechanisms 28A and 28B are arranged at the delivery position as shown in FIG. 27 (while the sheet W of the original material roll R2 is being delivered in FIG. 27, in a present stage, the original material roll R1 is being delivered). In other words, a case of the process by the controller 70 being started in a state where a delivery step is being executed in which the sheet W is being delivered from the delivery-side original material roll R1 will be described.

First, based on a result of detection by the remaining sheet amount detector 16, a determination is made on whether or not a remaining sheet amount of the delivery-side original material roll R1 is below a remaining amount set in advance (step S1).

When it is determined that the remaining sheet amount is below the remaining amount set in advance, as shown in FIG. 19, the joining mechanism 28B is rotated to the mounting position and, at the same time, suction by the suction holding member 33 is started (step S2).

Next, both arms 18*a* and 18*b* are rotated so that the suction roller 21 approaches the standby-side original material roll R2 and, at the same time, suction by the suction roller 21 is started (step S3). Accordingly, the suction roller 21 enters a state where the suction roller 21 is capable of coming into rolling contact with the standby-side original material roll R2 in accordance with rotational driving of the standby-side original material roll R2.

In this case, the standby-side original material roll R2 is rotated counterclockwise in FIG. 19 (step S4). In other words, in steps S1 and S4, a rotational driving process is performed in which the standby-side original material roll R2 is rotationally driven when the remaining amount of the sheet W of the delivery-side original material roll R1 falls below the remaining amount set in advance.

Next, a determination is made on whether or not the end section of the sheet W suctioned by the suction roller 21 is detected by the end section detector 27 (step S5: detecting step).

When it is determined that the end section of the sheet W is not detected, driving of the standby-side original material roll R2 in step S4 is continued.

On the other hand, when it is determined that the end section of the sheet W is detected as shown in FIG. 17, driving of the standby-side original material roll R2 is stopped (step S6), and the robot main body 47 is moved to the operating position as indicated by the chain double-dashed line in FIG. 1 and the hand 60 is arranged at a position (a preparation position) in a vicinity of the end section retrieving unit 7B (step S7).

Next, a position of the end section of the sheet W detected by the end section detector 27 is computed as shown in FIG. 17 (step S8), and the end section of the sheet W held by the suction roller 21 is grasped by the hand 60 as shown in FIG. 18 (step S9).

In this state, as shown in FIG. 19 and FIG. 20, the hand 60 is moved along a path set in advance so that the sheet W grasped by the hand 60 is guided via the support roller 6*b* to the suction surface 33*d* of the suction holding member 33 of the joining mechanism 28B (step S10).

In other words, in steps S1 to S10, a conveying step is performed in which the end section of the sheet W of the standby-side original material roll R2 is retrieved using the operation robot 3 and the end section of the sheet W is conveyed to the suction holding member 33 when the remaining amount of the sheet W of the delivery-side original material roll R1 falls below the remaining amount set in advance.

By executing step S10, when the end section of the sheet W is suctioned by the suction surface 33*d* as shown in FIG. 21, the hand 60 is released and, at the same time, the sheet W is smoothed by rubbing, along the suction surface 33*d*, the end section of the sheet W having been placed on the suction surface 33*d* by the hand 60 (step S11). Accordingly, even when the sheet W suctioned by the suction surface 33*d* is slack, the slack of the sheet W can be taken up before affixing the tape T as will be described later.

Next, as shown in FIG. 22, the tip section of the sheet W is folded along the pressed surface 33*e* with the hand 60 (step S12) and, the hand 60 is separated from the joining mechanism 28B to move the robot main body 47 to the standby position indicated by the solid line in FIG. 1 (step S13).

In this state, the tip section of the sheet W is pressed between the pressing member 34 and the pressed surface 33*e* by rotating the pressing member 34 (step S14).

Subsequently, both arms 18*a* and 18*b* are rotated so that the suction roller 21 separates from the standby-side original material roll R2 (step S15) and, the standby-side original material roll R2 is rotated in reverse (clockwise in FIG. 19) in order to take up the slack of the sheet W on the suction surface 33*d* (step S16).

In this state, the adhesive layer of the tape T is attached to the sheet W as shown in FIG. 23 by advancing the tape attaching mechanism 46 from the retreated position shown in FIG. 9 to a position set in advance (step S17), lowering the pushing tool 46*d*, and advancing the tape attaching mechanism 46 (step S18).

Next, the pushing tool 46*d* is raised and the tape attaching mechanism 46 is retreated to the retreated position (step S19), and the joining mechanism 28B is rotated to the delivery position as shown in FIG. 24 (step S20).

In this state, rotation of the delivery-side original material roll R1 is stopped (step S21). In step S21, at the same time the rotation of the delivery-side original material roll R1 is stopped, the upper roller group 6A and the lower roller group 6B of the sheet storage mechanism 6*h* shown in FIG. 1 are brought close to each other. Accordingly, even after the rotation of the delivery-side original material roll R1 is stopped, delivery of the sheet W can be continued in correspondence to a reduction in length of the path of the sheet W in the sheet storage mechanism 6*h*.

Subsequently, pressing of the sheet W by the pressing member 34 is released as shown in FIG. 24 (step S22), and the suction holding member 33 of the joining mechanism 28A is caused to protrude to the side of the suction holding member 33 of the joining mechanism 28B as shown in FIG. 25 (step S23). Accordingly, the end section of the sheet W of the standby-side original material roll R2 is joined to the intermediate section of the sheet W of the delivery-side original material roll R1.

In other words, in steps S12 to S23, a joining step is performed in which the end section of the sheet W of the standby-side original material roll R2 is joined to the intermediate section of the sheet W of the delivery-side original material roll R1 by moving the suction surface 33*d* of the suction holding member 33 toward the intermediate section of the sheet W of the delivery-side original material roll R1 while restricting movement of the end section of the sheet W with respect to the suction holding member 33.

In this state, by causing the cutting blade 35 and the pressing blade 36 of the joining mechanism 28A to protrude to the side of the joining mechanism 28B as shown in FIG. 26 (step S24), the sheet W of the delivery-side original material roll R1 is cut.

As a result, in accordance with tension applied to the sheet W, the sheet W is delivered from the standby-side original material roll. R2 as shown in FIG. 27 (the standby-side original material roll R2 becomes a next delivery-side original material roll). Subsequently, by attaching the new standby-side original material roll R1 to the roll holding unit 5A, when a remaining amount of the sheet W of the delivery-side original material roll R2 becomes small, an end section of the sheet W of the standby-side original material roll R1 can be joined to the sheet W of the delivery-side original material roll R2.

As described above, a sheet retrieval position (the suction roller 21) is set in advance for each of the plurality of original material rolls R1 and R2 held by the roll holding unit 5, and the end section of the sheet W can be conveyed from each of the sheet retrieval positions to the joining unit 8 by the operation robot 3.

Therefore, the end section of the sheet W can be conveyed from all original material rolls R1 and R2 held by the roll holding unit 5 to the joining unit 8 without changing holding positions of the original material rolls R1 and R2 at the roll holding unit 5.

As a result, a structure of the roll holding unit 5 can be simplified and the roll holding unit 5 can be downsized.

Furthermore, the first embodiment also achieves the following effects.

According to the first embodiment, since the turning section 56, the arms 57 to 59, and the motors 61 to 65 can be distanced from the joining unit 8 by moving the turning section 56, the arms 57 to 59, and the motors 61 to 65 to the standby position (the position indicated by the solid line in FIG. 1), maintainability of the joining unit 8 is improved.

Second Embodiment

Although the first embodiment includes a single joining unit 8 for joining the sheet W of the original material roll R1 and the sheet W of the original material roll R2 to each other, the joining unit 8 may be provided in plurality.

Figure 28:
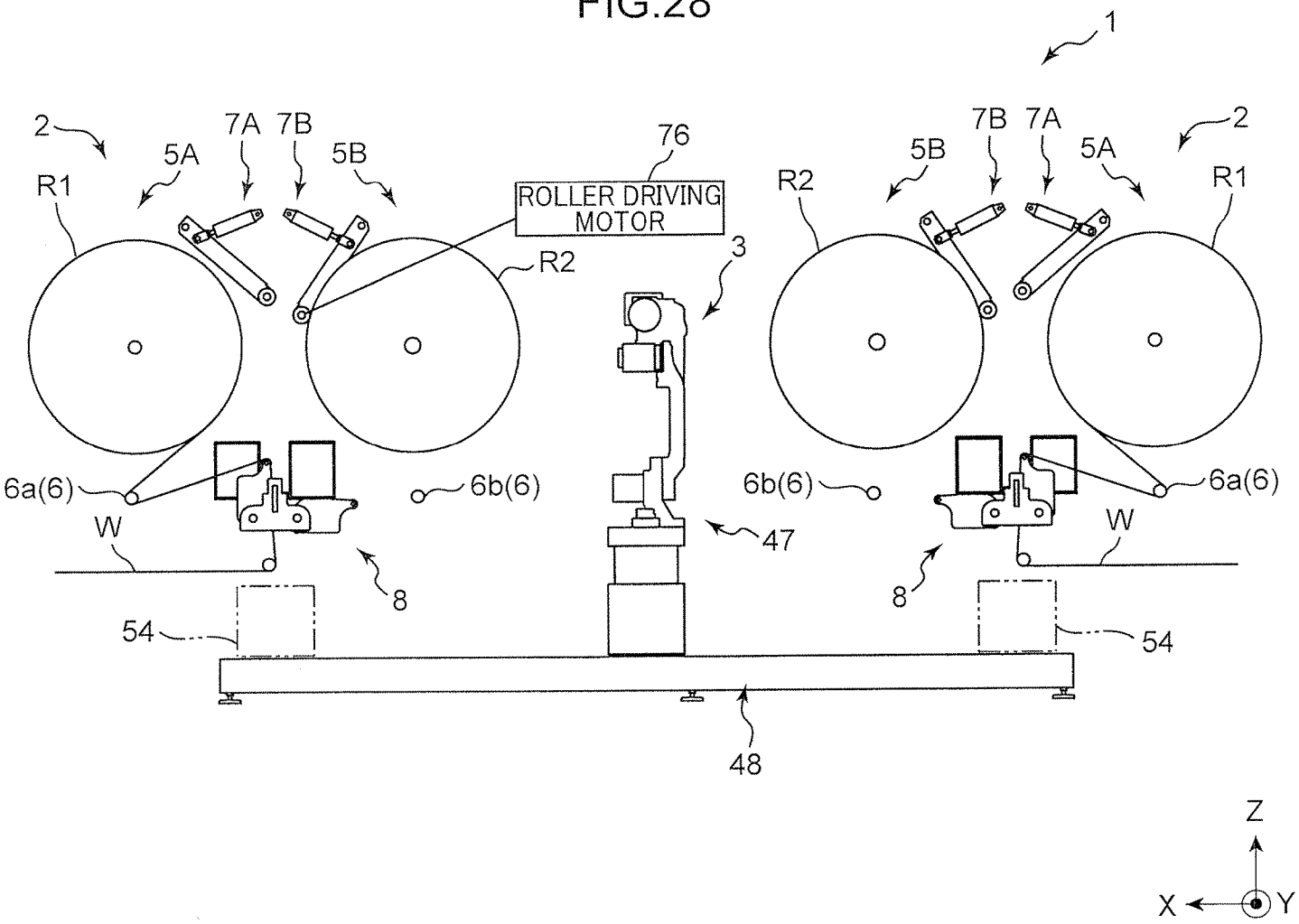
FIG. 28 is a front view showing an overall configuration of a sheet delivery system according to a second embodiment of the present invention.
Figure 29:
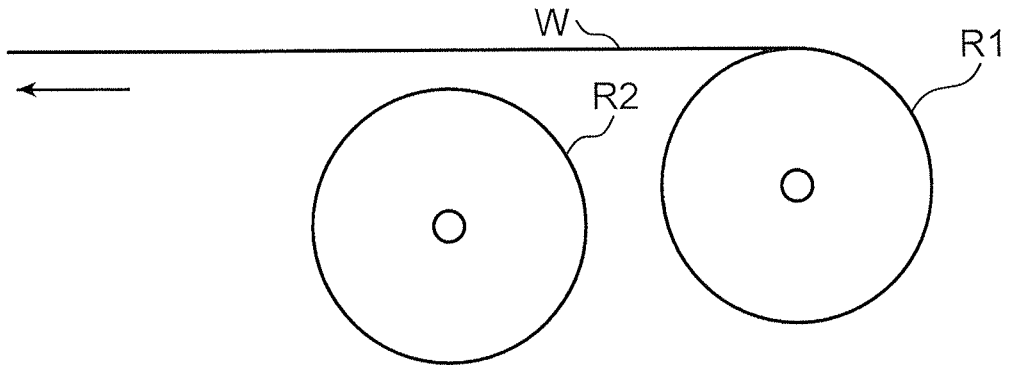
FIG. 29 is a conceptual diagram for explaining a joining operation and shows a state where a sheet is being delivered from a delivery-side original material roll.
Figure 30:
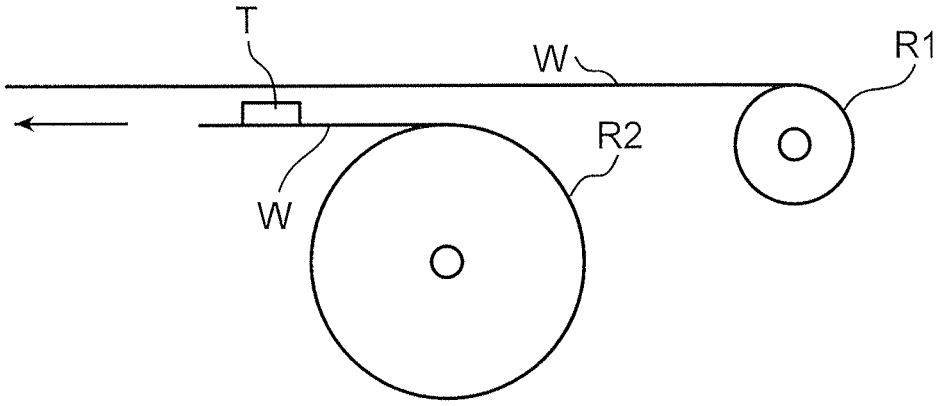
FIG. 30 is a conceptual diagram for explaining a joining operation and shows a state where a tape is affixed to a tip section of a sheet of a standby-side original material roll.
Figure 31:
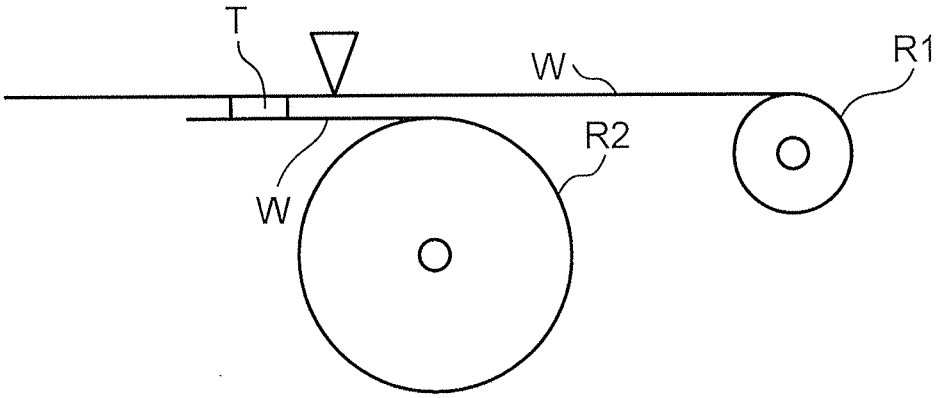
FIG. 31 is a conceptual diagram for explaining a joining operation and shows a state where a sheet of a delivery-side original material roll is to be cut after an intermediate section of the sheet of the delivery-side original material roll is joined to a tip section of a sheet of the standby-side original material roll.
Figure 32:
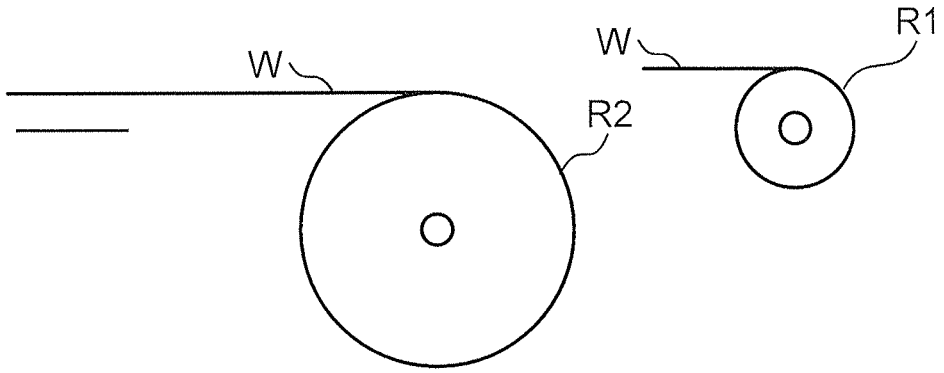
FIG. 32 is a conceptual diagram for explaining a joining operation and shows a state where delivery of a sheet of a standby-side original material roll is started.

Specifically, a sheet delivery system 1 according to the second embodiment shown in FIG. 28 includes two sheet delivery apparatuses 2 described earlier. Specifically, the sheet delivery system 1 further includes a joining unit 8 (an alternative joining unit) configured to perform a joining operation of a sheet W of original material rolls R1 and R2 (an alternative delivery-side original material roll and an alternative standby-side original material roll) which are separate from the original material rolls R1 and R2 described above. Therefore, sheets W of two types can be continuously delivered.

On the other hand, the sheet delivery system 1 according to the second embodiment includes a single operation robot 3 configured to convey the end section of the sheet W from each of four sheet retrieval positions (end section retrieving units 7A and 7B) to both joining units 8.

Specifically, the operation robot 3 according to the second embodiment includes a moving mechanism 48 which supports a robot main body 47 between two operating positions (positions indicated by chain double-dashed lines in FIG. 28) at which one joining unit 8, one end section retrieving unit 7A, and one end section retrieving unit 7B are arranged in a movement range of a hand 60, and a standby position (a position indicated by a solid line in FIG. 28) at which the robot main body 47 is retreated in comparison to the operating positions.

Accordingly, joining operations at the two joining units 8 can be executed by one operation robot 3.

Moreover, while an example in which two joining units 8 are provided has been described, joining operations can be performed by one operation robot 3 even when a plurality of joining units 8 are provided.

In addition, the sheet delivery system 1 according to the second embodiment includes a roller driving motor (a suction roller driving unit) 76 which rotationally drives a suction roller 21. Therefore, a sheet holding position at which the sheet W is held by the hand 60 can always be kept constant.

For example, a case where a position of the suction roller 21 (the end section of the sheet W) indicated by the solid line in FIG. 17 is set in advance as a sheet holding position will be described. When the end section of the sheet W is detected at the position indicated by the chain double-dashed line in FIG. 17, the suction roller 21 can be rotated to the sheet holding position by rotating both arms 18*a* and 18*b* based on a result of detection by a rotational angle detector 25.

However, rotating both arms 18*a* and 18*b* causes the suction roller 21 to rotate due to tension created on the sheet W and changes a position of the end section of the sheet W.

In consideration thereof, by rotating the suction roller 21 with the roller driving motor 76, the position of the end section of the sheet W can be returned to a position which can be detected by an end section detector 27 or, in other words, the sheet holding position.

As described above, according to the second embodiment, since a common operation robot 3 can be used with respect to a plurality of joining units 8, an increase in cost when a plurality of joining units 8 are required can be suppressed.

Furthermore, while an example in which two original material rolls R1 and R2 are held with respect to one joining unit 8 has been described, a plurality of original material rolls may be held with respect to one joining unit 8.

The specific embodiment described above mainly includes an invention configured as described below.

The present invention provides a sheet delivery system for continuously delivering a sheet, the sheet delivery system including: a roll holding unit which holds a plurality of original material rolls each formed by winding a sheet, in a state where delivery of the sheet is allowed; a joining unit which joins, to an intermediate section of a sheet being delivered from a delivery-side original material roll among the plurality of original material rolls held by the roll holding unit, an end section of a sheet of a standby-side original material roll that is a roll other than the delivery-side original material roll among the plurality of original material rolls held by the roll holding unit; and an end section conveying apparatus which retrieves the end section of the sheet from the standby-side original material roll and which conveys the end section of the sheet to the joining unit, wherein the sheet delivery system sets, in advance, a sheet retrieval position for retrieving a sheet from each of the plurality of original material rolls, for each of the plurality of original material rolls held by the roll holding unit, and the end section conveying apparatus is configured to convey the end section of the sheet from each of the sheet retrieval positions to the joining unit.

In the present invention, a sheet retrieval position is set in advance for each of a plurality of original material rolls held by the roll holding unit, and an end section of a sheet can be conveyed from each of the sheet retrieval positions to the joining unit by the end section conveying apparatus.

Therefore, an end section of a sheet can be conveyed from all original material rolls held by the roll holding unit to the joining unit without changing holding positions of the original material rolls at the roll holding unit.

As a result, according to the present invention, a structure of a roll holding unit can be simplified and the roll holding unit can be downsized.

When the end section conveying apparatus includes a grasping unit which is capable of grasping the end section of the sheet of the standby-side original material roll and a supporting mechanism which supports the grasping unit in a state where the grasping unit is movable within a movement range set in advance, the supporting mechanism may be fixed so that the joining unit and the sheet retrieval position are included in the movement range of the grasping unit.

However, in this case, since the grasping unit always moves via the joining unit, the supporting mechanism which supports the grasping unit and the joining unit are arranged adjacent to each other. As a result, a problem of poor maintainability of the joining unit arises.

In consideration, in the sheet delivery system described above, the end section conveying apparatus favorably includes: a grasping unit configured to grasp the end section of the sheet of the standby-side original material roll; a supporting mechanism which supports the grasping unit in a state where the grasping unit is movable within a movement range set in advance; and a moving mechanism which movably supports the supporting mechanism between an operating position at which the joining unit and the sheet retrieval position with respect to the standby-side original material roll are included in the movement range, and a standby position at which the supporting mechanism is separated from the joining unit as compared to the operating position.

According to this aspect, since the supporting mechanism can be separated from the joining unit by moving the supporting mechanism to the standby position, maintainability of the joining unit is improved.

Although the sheet delivery system may include only one joining unit, the sheet delivery system may include a plurality of joining units. In this case, providing one end section conveying apparatus for each joining unit significantly increases cost.

In consideration thereof, favorably, the sheet delivery system further includes an alternative joining unit which joins, to an intermediate section of a sheet being delivered from an alternative delivery-side original material roll that is a roll other than the delivery-side original material roll and the standby-side original material roll among the plurality of original material rolls held by the roll holding unit, an end section of a sheet of an alternative standby-side original material roll that is a roll other than the delivery-side original material roll, the alternative delivery-side original material roll, and the standby-side original material roll among the plurality of original material rolls held by the roll holding unit, wherein the end section conveying apparatus is configured to convey the end section of the sheet from each of the sheet retrieval positions to the alternative joining unit.

According to this aspect, since a common end section conveying apparatus can be used with respect to a plurality of joining units, an increase in cost when a plurality of joining units are required can be suppressed.

In addition, the present invention provides a sheet delivery method using the sheet delivery system described above, the sheet delivery method including: a delivery step of delivering a sheet from the delivery-side original material roll; a conveying step of retrieving an end section of a sheet from a sheet retrieval position for the standby-side original material roll and conveying the end section of the sheet to the joining unit using the end section conveying apparatus when a remaining sheet amount of the delivery-side original material roll falls below a remaining amount set in advance by the delivery step; and a joining step of joining the end section of the sheet of the standby-side original material roll to an intermediate section of the sheet of the delivery-side original material roll using the joining unit.

According to the present invention, an end section of a sheet of a standby-side original material roll can be conveyed to the joining unit without changing a holding position of an original material roll at the roll holding unit.

Therefore, according to the present invention, a sheet delivery method can be simplified as compared to the conventional art in which a holding position of an original material roll is changed.

The invention claimed is:

1. A sheet delivery system for continuously delivering a sheet, the sheet delivery system comprising:

a supporting member;

a roll holding unit which includes holding shafts provided to the supporting member and rotatably fixed to the supporting member in a state where the holding shafts are apart from each other, the holding shafts being configured to respectively hold original material rolls each formed by winding a sheet, in a state where delivery of the sheet is allowed;

a joining unit configured to join, to an intermediate section of a sheet being delivered from a delivery-side original material roll among the original material rolls held by the holding shafts, an end section of a sheet of a standby-side original material roll that is a roll other than the delivery-side original material roll among the original material rolls held by the holding shafts, the joining unit including an supporting plate provided to the supporting member in a state where a movement of the supporting plate with respect to the supporting member is restricted, and joining mechanisms attached to the supporting plate; and an end section conveying apparatus configured to retrieve the end section of the sheet from the standby-side original material roll and convey the end section of the sheet to the joining unit, wherein:

the sheet delivery system is configured to set, in advance, a sheet retrieval position for retrieving a sheet from each of the original material rolls, for each of the original material rolls held by the holding shafts; and the end section conveying apparatus is configured to move between an operating position at which the end section conveying apparatus is configured to retrieve the end section of the sheet at each of the sheet retrieval positions and convey the end section of the sheet to the joining mechanisms attached to the supporting plate, and a standby position at which the end section conveying apparatus is further apart from the joining mechanisms than when the end section conveying apparatus is at the operating position.

2. The sheet delivery system according to claim 1, wherein the end section conveying apparatus includes:

a grasping unit configured to grasp the end section of the sheet of the standby-side original material roll;

a supporting mechanism configured to support the grasping unit in a state where the grasping unit is movable within a movement range set in advance; and a moving mechanism configured to movably support the supporting mechanism between the operating position at which the joining unit and the sheet retrieval position with respect to the standby-side original material roll are included in the movement range, and the standby position at which the supporting mechanism is separated from the joining unit as compared to the operating position.

3. The sheet delivery system according to claim 1, further comprising:

an alternative joining unit configured to join, to an intermediate section of a sheet being delivered from an alternative delivery-side original material roll that is a roll other than the delivery-side original material roll and the standby-side original material roll among the original material rolls held by the holding shafts, an end section of a sheet of an alternative standby-side original material roll that is a roll other than the delivery-side original material roll, the alternative delivery-side original material roll, and the standby-side original material roll among the original material rolls held by the holding shafts, wherein the end section conveying apparatus is configured to convey the end section of the sheet from each of the sheet retrieval positions to the alternative joining unit.

4. A sheet delivery method using the sheet delivery system according to claim 1, the sheet delivery method comprising:

delivering a sheet from the delivery-side original material roll;

retrieving an end section of a sheet from a sheet retrieval position for the standby-side original material roll and conveying the end section of the sheet to the joining unit using the end section conveying apparatus when a remaining sheet amount of the delivery-side original material roll falls below a remaining amount set in advance by the delivering the sheet from the delivery-side original material roll; and joining the end section of the sheet of the standby-side original material roll to an intermediate section of the sheet of the delivery-side original material roll using the joining unit.

* * * * *